US011608575B2

(12) United States Patent
Pogl et al.

(10) Patent No.: US 11,608,575 B2
(45) Date of Patent: Mar. 21, 2023

(54) KNITTED SHOE UPPER WITH INTEGRAL EYELETS

(71) Applicant: adidas AG, Herzogenaurach (DE)

(72) Inventors: Florian Pogl, Fuerth (DE); Marco Fischhold, Herzogenaurach (DE); Ping Li, Herzogenaurach (DE); Goran Duz, Herzogenaurach (DE); Florian Godenberg, Neustadt an der Aisch (DE); Matthias Linz, Scheinfeld (DE); Stefan Mohr, Herzogenaurach (DE); Sergius Merker, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 80 days.

(21) Appl. No.: 17/119,774

(22) Filed: Dec. 11, 2020

(65) Prior Publication Data

US 2021/0186156 A1 Jun. 24, 2021

(30) Foreign Application Priority Data

Dec. 20, 2019 (DE) ..... 102019220470.8

(51) Int. Cl.

| | |
|---|---|
| ***D04B 1/04*** | (2006.01) |
| ***D04B 1/10*** | (2006.01) |
| ***A43B 1/04*** | (2022.01) |
| ***A43C 5/00*** | (2006.01) |
| *D04B 1/24* | (2006.01) |

(Continued)

(52) U.S. Cl.

CPC ..... *D04B 1/102* (2013.01); *A43B 1/04* (2013.01); *A43C 5/00* (2013.01); *D04B 1/24* (2013.01); *D04B 21/08* (2013.01); *D04B 21/18* (2013.01); *D04B 21/207* (2013.01); *D10B 2401/04* (2013.01); *D10B 2401/061* (2013.01);

(Continued)

(58) Field of Classification Search

CPC ..... D04B 1/10; D04B 1/22; D04B 1/24; D04B 7/30; D04B 1/108; D04B 9/42; A43B 1/04

See application file for complete search history.

(56) References Cited

U.S. PATENT DOCUMENTS 8,973,410 B1 * 3/2015 Podhajny ..... A43B 1/04 36/47
9,192,204 B1 * 11/2015 Liles ..... A43C 1/04

(Continued)

FOREIGN PATENT DOCUMENTS

CN 203986311 U 12/2014
CN 205884826 U 1/2017

(Continued)

OTHER PUBLICATIONS

Extended European Search Report in EP App. No. 20213077.9, dated May 14, 2021 (10 pages).

*Primary Examiner* — Danny Worrell
(74) *Attorney, Agent, or Firm* — Sterne, Kessler, Goldstein & Fox P.L.L.C.

(57) ABSTRACT

The present invention relates to a shoe upper including a knitted component having a plurality of integrally knitted lines of loops including a set of consecutive lines, wherein each line in the set of consecutive lines includes a plurality of consecutive loops which are interlooped with adjacent loops of the respective line and not interlooped with loops of a line which is not contained in the set, and wherein the set of consecutive lines forms at least a portion of an eyelet which is configured to receive a lace.

22 Claims, 23 Drawing Sheets

(51) Int. Cl.

| | |
|---|---|
| *D04B 21/08* | (2006.01) |
| *D04B 21/18* | (2006.01) |
| *D04B 21/20* | (2006.01) |

(52) U.S. Cl.
CPC ..... *D10B 2403/0113* (2013.01); *D10B 2403/023* (2013.01); *D10B 2501/043* (2013.01)

(56) References Cited

U.S. PATENT DOCUMENTS

| | | | | |
|---|---|---|---|---|
| 9,301,567 | B2 * | 4/2016 | Dealey | A43B 23/042 |
| 9,888,743 | B2 * | 2/2018 | Bell | A43B 23/027 |
| D932,762 | S * | 10/2021 | Vella | D2/973 |
| 2008/0110048 | A1 * | 5/2008 | Dua | A43B 3/0031 12/146 C |
| 2008/0110049 | A1 | 5/2008 | Sokolowski et al. | |
| 2015/0059210 | A1 * | 3/2015 | Droege | A43B 23/0255 12/142 R |
| 2015/0107307 | A1 | 4/2015 | Kosui et al. | |
| 2017/0208900 | A1 | 7/2017 | Boucher et al. | |
| 2018/0110283 | A1 | 4/2018 | Brinkman et al. | |
| 2018/0255877 | A1 | 9/2018 | Wilson | |
| 2018/0332920 | A1 | 11/2018 | Burch | |
| 2019/0037966 | A1 | 2/2019 | Aceves Tinajero et al. | |
| 2019/0328075 | A1 * | 10/2019 | Poulsen | A43B 23/0265 |

FOREIGN PATENT DOCUMENTS

| | | | |
|---|---|---|---|
| CN | 106723611 | A | 5/2017 |
| CN | 108283336 | A | 7/2018 |
| CN | 108294407 | A | 7/2018 |
| EP | 3385420 | A1 | 10/2018 |
| WO | 2013/108506 | A1 | 7/2013 |
| WO | WO 2019/001676 | A1 | 1/2019 |
| WO | 2020033794 | A1 | 2/2020 |

* cited by examiner

KNITTED SHOE UPPER WITH INTEGRAL EYELETS

TECHNICAL FIELD

The present invention relates to a knitted shoe upper with integral eyelets and a corresponding manufacturing method.

PRIOR ART

Despite many replacement attempts, laces are still one of the most convenient means to secure a shoe to a foot of a wearer. Eyelets are required on the shoe upper to guide the laces and to allow for a proper fastening of the shoe. Usually, the eyelets are provided either as (punched) holes in the material of the shoe upper or as additional elements, e.g. lugs, attached to the material of the shoe upper.

Providing the eyelets in this way requires additional manufacturing steps, be it the punching of holes or the attaching of additional elements. For example, US 2018/0110283 A1 discloses an upper including a knitted component. In addition to intermeshed loops, the knitted component may include one or more structures forming lace apertures. The structures may include a first end, a second end and a central portion. The first end and the second end may be secured to a surface of the knitted component. In some embodiments, for example, a fusible material may be included in yarn forming the surface, the structure, or both. The fusible material may be activated (e.g., at least partially melted) when subjected to heat and then cooled to thereby affix the first end, the second end, or both. Additionally, or alternatively, the securement of the first end, the second end, or both may be enhanced in another suitable manner, such as by sewing, by use of an adhesive, by tying, by mechanical clamping, etc.

WO 2019/001676 A1 relates to a shoe, especially to a sports shoe, comprising a shoe upper, wherein the shoe upper consists at least partially of a knitted fabric, wherein the shoe upper has a plurality of loops for threading a lace to allow the tying of the shoe at the foot of a wearer by means of the lace. To provide an easy and efficient possibility to adjust the lacing or tying of the shoe at the foot of the wearer individually, at least a part of the loops consists of a knitted fabric, wherein the loops have the shape of a tubular body which forms a passage for the lace.

US 2018/0255877 A1 relates to an article of footwear including a sole, an upper, and a reconfigurable fastening system. The upper is coupled to the sole and includes medial and lateral quarters. Disposed on the medial and lateral quarters are a plurality of eyelets. Each of the eyelets includes a pair of openings disposed in the upper. The plurality of eyelets further includes at least one elongate member threaded through the pair of openings of each eyelet. The elongate member includes a series of first, or unexposed, portions that are disposed on an inner surface of the upper, and a series of second, or exposed, portions that are disposed on the outer surface of the upper. A fastener or lacing may be selectively threaded through an eyelet of the plurality of eyelets, where the fastener may be threaded between the second portion of the elongate member and the outer surface of the upper.

Further prior art is disclosed in CN 203986311 U.

It is therefore, the objective of the present invention to provide a shoe upper configured for using a lace that can be manufactured with less manufacturing steps compared to the prior art.

SUMMARY OF THE INVENTION

This objective is met by a shoe upper according to claim 1. The shoe upper according to the present invention comprises a knitted component comprising a plurality of integrally knitted lines of loops comprising a set of consecutive lines, wherein each line in the set of consecutive lines comprises a plurality of consecutive loops which are interlooped with adjacent loops of the respective line and not interlooped with loops of a line which is not contained in the set, and wherein the set of consecutive lines forms at least a portion of an eyelet which is configured to receive a lace.

In the context of the present invention, "line" may either be a course or a wale and the knitted component may be weft-knitted or warp-knitted.

The invention allows formation of eyelets in a shoe upper without additional manufacturing steps. The eyelets are provided as consecutive lines of loops that are interlooped within each line and also with adjacent loops of adjacent lines in the set, but not interlooped with lines that are not part of the set of consecutive lines. The set of consecutive lines form a kind of integral lug within the knitted component for receiving a lace. Additional manufacturing steps for providing the eyelets are not needed.

The set of consecutive lines may be knitted by means of partial knitting. In partial knitting, a group of loops is formed by knitting, while other loops are held in the needles in a non-knit position. Thus, the loops are held or parked while surrounding needles (selected by the knitting program) are creating stitches. Partial knitting may be performed by a knitting machine programmed accordingly. Partial knitting allows to provide the raised eyelets of the shoe upper directly during knitting as integrated structures by providing the lines within the set of consecutive lines with additional loops with respect to the lines not pertaining to the set of consecutive lines. In this way, partial knitting allows to provide the eyelets with a curved shape protruding from the surface of the knit component.

The lines may be wales.

The first line in the set of consecutive lines and a first adjacent line not contained in the set may form a first aperture in the knitted component, wherein the last line in the set of consecutive lines and a second adjacent line not contained in the set may form a second aperture in the knitted component, and wherein the first and the second apertures may be configured, such that a lace may pass through both apertures. The apertures are advantageously formed during the knitting process. Additional manufacturing steps like hole punching can be avoided.

A first line in the set of consecutive lines may extend from a first end of the eyelet to a second end of the eyelet and may comprise a first number of loops, and a second line not contained in the set may comprise all loops between a loop adjacent the first end of the eyelet and a loop adjacent the second end of the eyelet and may comprise a second number of loops, wherein the first number may be higher than the second number. This allows the lines of loops forming the eyelet to protrude from a surface of the knitted component which facilitates threading the lace. The eyelet may protrude like a lug but is integrally formed in the knitted component.

The eyelet may have a width between 5 mm and 15 mm. Preferably, the eyelet may have a width between 7 mm and 10 mm. The set of consecutive lines may comprise 2-10 lines. The inventors have discovered that such a width is optimal for threading a lace, but at the same time is sufficiently stable and tear-resistant.

The lines in the set of consecutive lines of loops may have a length between 10 mm and 30 mm. Preferably, the lines in the set of consecutive lines of loops may have a length between 15 mm and 25 mm. Each line in the set of consecutive lines of loops may comprise 15-25 loops. The inventors have discovered that such a length is optimal for threading a conventional lace.

The number of loops of a line located between the first line and the last line in the set of consecutive lines of loops may be higher than the number of loops of the first and the last line. This provides a more stable and reinforced eyelet which keeps its shape better due to knitting a solid structure. Also, this ensures a nicer look and avoids a bumpy edge. It also gives the eyelets a more rounded shape. A half-cardigan knit can be used at the edges of the eyelet.

The knitted component may comprise at least one fusible yarn in the area of the set of consecutive lines of loops. This provides resistance to abrasion and reduces deformation of the eyelet. The at least one fusible yarn may be used alone or in combination with other non-fusible yarns, such as for instance a polyester yarn or an elastic yarn. In this case the fusible yarn may be normally knitted together with the non-fusible yarn or elastic yarn, or it could be plated, for instance towards an internal surface, so that the external appearance of the knitted component is not affected by the presence of the fusible yarn.

The fusible yarn may be located only in the lines of the set of consecutive lines of loops. This provides the eyelets with sufficient stiffness and stability, while maintaining the overall stretchability of the shoe upper. Alternatively, the fusible yarn may be provided in the area of the lace bars, which is the area around the eyelets, to provide support specifically to this area. Lace bars may be defined on the lateral and medial side of the instep area of the shoe upper by a plurality of sets of consecutive lines as described herein. Preferably, those sets and the eyelets formed by them are aligned.

The fusible yarn may be selected among a polyester yarn, a polyamide yarn or a urethane-based yarn. A fusible yarn can be made out of TPU, Polyamide (PA6+PA66), Polyester (drawing while spinning has a huge impact) and paraffin. Preferably, the fusible yarn used is a low melting yarn, i.e. a yarn having a melting temperature preferably between 50° C. and 100° C. Alternatively, the fusible yarn could be selected among polyamide or fusible polyester based yarns.

The shoe upper may comprise an inner knitted layer and an outer knitted layer in a unitary knit construction, wherein the inner layer and the outer layer are connected at least in a collar region of the shoe upper, and wherein the outer layer is put over the inner layer or, wherein the inner layer is inserted into the outer layer. This adds to the stability and comfort of the shoe upper. In addition, the two layers may be provided with different functionality. For example, the inner layer may be made from a soft, moisture-wicking yarn, whereas the outer layer may be made from an abrasion-resistant yarn.

The set of consecutive lines of loops may be located on an outer layer. This allows for an easy threading of the lace.

The two layers may overlap in the area of the set of consecutive lines of loops. In this way, the underlying layer may act as a cushioning underneath the eyelet.

The two layers may not be connected in the area of the set of consecutive lines of loops. In this area, the two layers may just overlap to allow a relative movement when the laces are tightened.

The two layers may overlap in the area of the instep of the upper and may not be connected in the area of the instep. This allows for a better fit, since the inner layer or sock surrounds and holds the foot, while the outer layer or sock can be independently adjusted via the lacing. In this manner the outer sock keeps a better shape. The shoe upper may be a sock-in-sock construction, with the two layers defining an internal and an external sock. Preferably, the two layers are made by means of a small circular knitting machine, in particular each layer being a single jersey layer.

The knitted component may comprise at least one elastic yarn in the area of the set of consecutive lines of loops. The elastic yarn helps the eyelet to acquire and maintain the desired shape. The elastic yarn may be used alternatively or additionally to a fusible yarn, non-fusible yarn, or both. If only elastic yarn is added to the eyelet, costs for the fusible yarn, which is usually expensive, can be saved. The inventors realized that elastic yarn may be sufficient to maintain the shape of the eyelets.

The elastic yarn may be located only in the lines of the set of consecutive lines of loops. Thus, the elastic yarn may specifically stabilize the eyelets. The elastic yarn may alternatively or additionally be placed all along a lace bar of the shoe upper.

The elastic yarn may be more elastic than another yarn of the knitted component.

The present invention also relates to a shoe comprising a shoe upper according to the invention as described herein and a sole structure attached to the shoe upper.

The present invention is also directed to a method of manufacturing a shoe upper comprising the steps: providing a knitted component; providing the knitted component with a plurality of integrally knitted lines of loops comprising a set of consecutive lines, such that each line in the set of consecutive lines comprises a plurality of consecutive loops which are interlooped with adjacent loops of the respective line and not interlooped with loops of a line which is not contained in the set; and forming the set of consecutive lines as at least a portion of an eyelet which is configured to receive a lace.

The mentioned advantages of the shoe upper according to the invention are also realized in the corresponding manufacturing method and will not be repeated here. This is also true for the following embodiments of the method. Additional advantages will be mentioned, if needed.

The method may further comprise the step of knitting the set of consecutive lines by means of partial knitting.

In the method, the lines may be wales.

The method may further comprise the steps: forming a first aperture in the knitted component using the first line in the set of consecutive lines and a first adjacent line not contained in the set; forming a second aperture in the knitted component using the last line in the set of consecutive lines and a second adjacent line not contained in the set form; and configuring the first and the second aperture, such that a lace may pass through both apertures.

In the method, a first line in the set of consecutive lines may extend from a first end of the eyelet to a second end of the eyelet and may comprise a first number of loops, and a second line not contained in the set may comprise all loops between a loop adjacent the first end of the eyelet and a loop adjacent the second end of the eyelet and may comprise a second number of loops, wherein the first number may be higher than the second number.

In the method, the eyelet may have a width between 5 mm and 15 mm.

In the method, the set of consecutive lines may comprise 4-10 lines.

In the method, the lines in the set of consecutive lines of loops may have a length between 10 mm and 30 mm.

In the method, each line in the set of consecutive lines of loops may comprise 15-25 loops.

In the method, the number of loops of a line located between the first line and the last line in the set of consecutive lines of loops may be higher than the number of loops of the first and the last line.

The method may further comprise the step of arranging at least one fusible yarn in the area of the set of consecutive lines of loops.

The method may further comprise the step of arranging the fusible yarn only in the lines of the set of consecutive lines of loops.

In the method, the fusible yarn may be selected among a polyester yarn, a polyamide yarn or a urethane-based yarn. The yarn may comprise thermoplastic polyurethane (TPU).

The method may further comprise the steps: providing an inner knitted layer and an outer knitted layer in a unitary knit construction; connecting the inner layer and the outer layer at least in a collar region of the shoe upper to form the shoe upper; and putting the outer layer over the inner layer or, inserting the inner layer into the outer layer to form the shoe upper. Connecting the two layers in the collar region may by done integrally during knitting the two layers so the transition from the inner layer to the outer layer is seamless. Additionally, the two layers may be connected in another region, e.g. a toe or sole region, for example by stitching.

The method may further comprise the step of forming the set of consecutive lines of loops on an outer layer.

In the method, the two layers may overlap in the area of the set of consecutive lines of loops.

In the method, the two layers may not be connected in the area of the set of consecutive lines of loops.

In the method, the two layers may overlap in the area of the instep of the upper and are not connected in the area of the instep.

The method may further comprise the step of providing at least one elastic yarn in the area of the set of consecutive lines of loops. As mentioned, a fusible yarn may be omitted in this case. If no fusible yarn is present in the eyelet area, then in the manufacturing method there is no need for a step of placing pins inside each of the lace loops during heat setting as will be described below. Heat setting may still be performed to release the torques on the yarns deriving from the knitting process and stabilize the shape of the shoe upper, but no specific heat setting steps for fusing fusible yarn on the eyelets is needed.

The method may comprise the step of heat setting the upper. Heat setting may be done in a temperature range of 50° C.-130° C. This range covers almost all relevant materials without destroying a part of them. More specifically, heat setting may be performed at a temperature of about 100° C. Heat setting may be performed in a steaming box.

The method may further comprise the step of arranging the elastic yarn only in the lines of the set of consecutive lines of loops.

In the method, the elastic yarn may be more elastic than another yarn of the knitted component.

The method may further comprise the step of using a small circular knitting machine for providing the knit component.

The method may further comprise the step of placing pins inside the eyelet formed by the set of consecutive lines of loops and maintaining the pins in the eyelet during heat setting the shoe upper. This may be advantageous if the eyelets are provided with a fusible yarn to stabilize and shape the eyelets during heat setting.

The method may further comprise the step of heat setting the shoe upper.

The present invention also relates to a shoe upper obtained by a method according to the invention as described herein.

BRIEF DESCRIPTION OF THE DRAWINGS

The presently preferred embodiments of the invention are described in the following detailed description with reference to the following figures.

DETAILED DESCRIPTION OF PREFERRED EMBODIMENTS

Figure 1A:
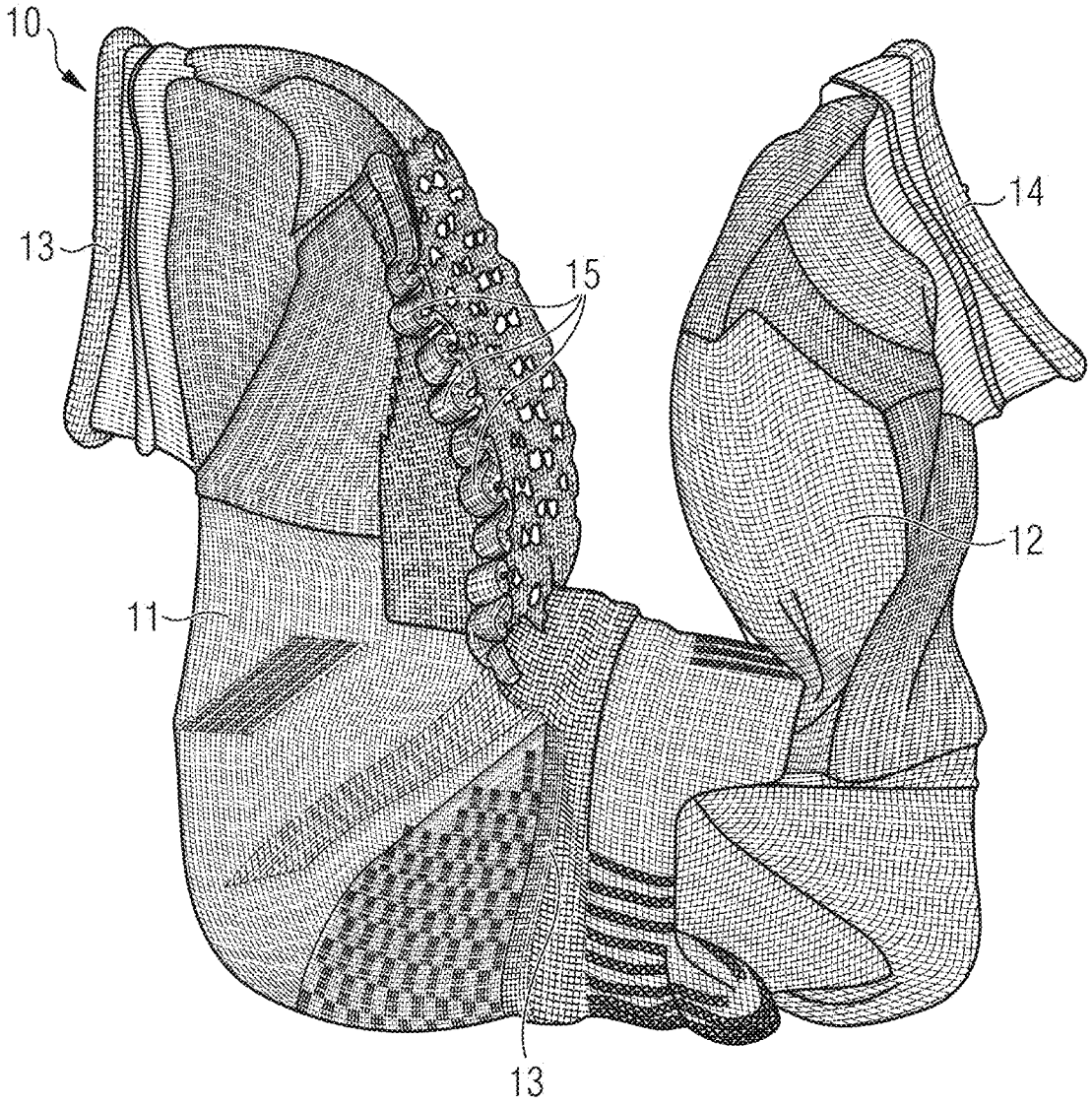
FIGS. 1A and 1B show an embodiment of a shoe upper 10 according to the present invention.
Figure 1B:
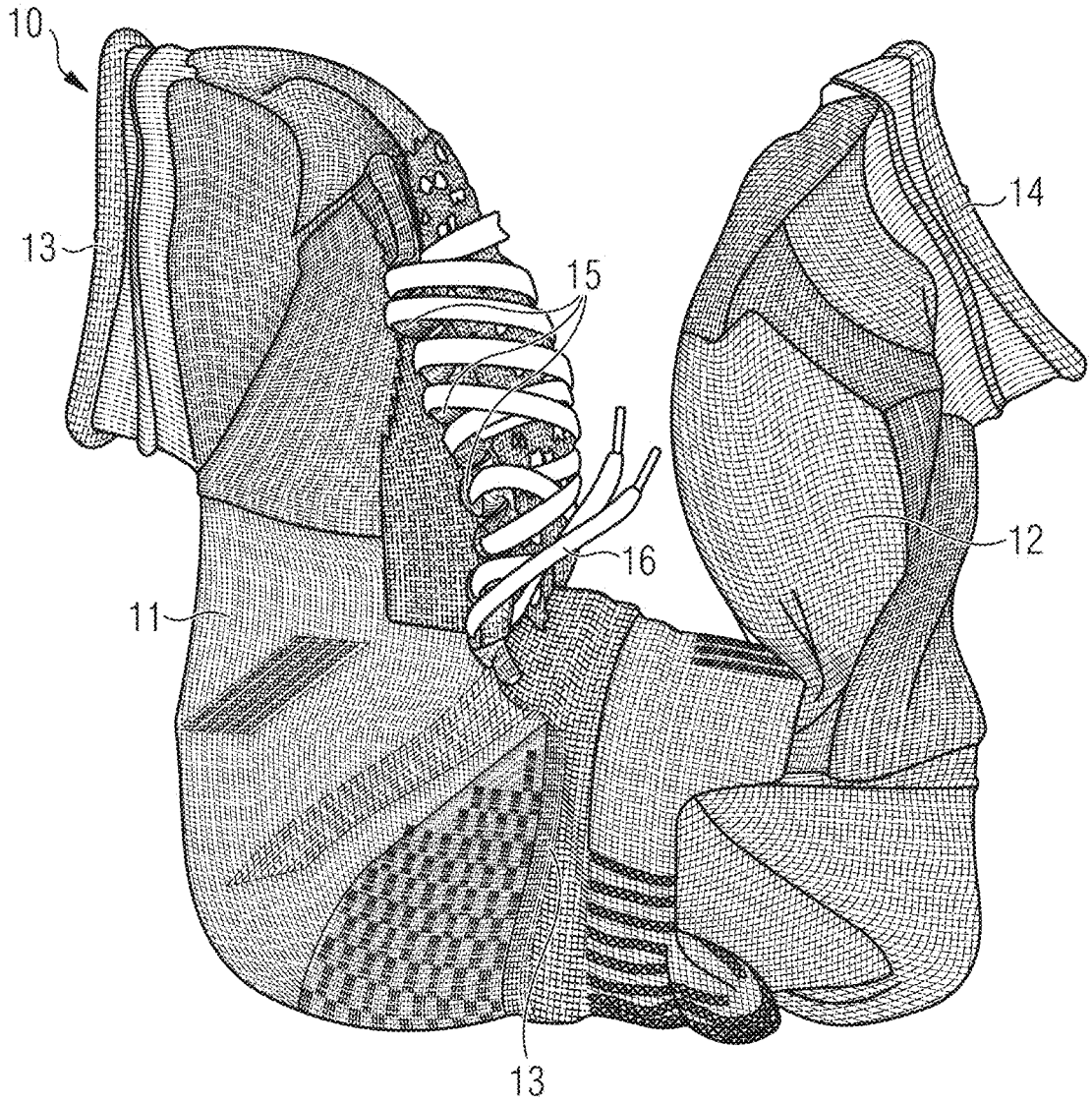

FIGS. 1A and 1B show an embodiment of a shoe upper 10 according to the present invention. In this embodiment, the shoe upper 10 is made from two sock-like layers 11 and 12 which are connected at a collar region 13 of the respective sock-like layers 11 and 12. In the embodiment of FIGS. 1A and 1B, both layers are made as one piece in a single knitting process on a small circular knitting machine, i.e. as a unitary knit construction. The two socks 11 and 12 are created as a continuous, preferably single jersey, cylinder-shaped knitted fabric. Generally, in the context of the present invention the shoe upper may have a different number of layers, e.g. just a single layer. In case of two layers, the layers may also be made separately and then joined, e.g. by linking, sewing, welding, gluing, etc. Also, instead of a small circular knitting machine, a medium or large circular knitting machine or a flat knitting machine may be used. The machine may have one, two or even more than two needle beds. Generally, in the context of the present invention, weft-knitting or warp-knitting may be used. Suitable knitting yarns may be based on synthetic materials like polyester, but natural yarns, such as cotton, may be used as well.

Coming back to the embodiment of FIGS. 1A and 1B, the layer 11 is the outer layer of the shoe upper 10, whereas the layer 12 is the inner layer of the shoe upper 10. The outer layer 11 is put over the inner layer 12 and both layers are joined at their respective free ends 13 and 14 for example by linking, sewing, welding or gluing. Since the socks 11 and 12 are each made as a cylinder, they comprise openings at their respective free ends 13 and 14 which are also closed by this process. The openings are preferably longitudinal on the bottom of the layers (socks), so that the seam can be completely hidden by the sole. In the final shoe upper 10, the connected free ends will be arranged in a sole area of the shoe upper 10 and, therefore, will not be visible. The inner layer 12 is inserted into the outer layer 11. Alternatively, the outer layer 11 may be put over inner layer 12. Putting over the outer layer 11 over the inner layer 12 may be done on a last.

The outer layer 11 of the embodiment of FIGS. 1A and 1B is a knitted component of the shoe upper 10. In this embodiment, the knitted component makes up a large portion of the shoe upper 10. In other embodiments, the knitted component may be smaller and only make up a portion of the shoe upper 10. Other portions of the shoe upper may then be made from different materials, e.g. leather, artificial leather, woven, non-woven, mesh, etc.

The knitted component, i.e. the outer layer 11 comprises a plurality of integrally knitted lines of loops. Generally, a knitted fabric is obtained by interlooping at least one yarn so that lines of loops are obtained. In the context of the present invention, a line may either be a course or a wale. The knitted component 11 comprises a set of consecutive lines, wherein each line in the set of consecutive lines comprises a plurality of consecutive loops which are interlooped with adjacent loops of the respective line and are not interlooped with loops of a line which is not contained in the set. Thus, the loops of the lines of this set are connected to only to loops within the same line or to adjacent loops of an adjacent line within the set, but not to loops of lines which are not contained in the set. In this way, the set of consecutive lines forms at least a portion of an eyelet which is configured to receive a lace 16. In the embodiment of FIGS. 1A and 1B, three of those eyelets are denoted by the reference numeral 15. FIG. 1A shows the shoe upper 10 without a lace, wherein in FIG. 1B, a lace 16 has been threaded through the eyelets 15.

In the example of FIGS. 1A and 1B, the set of consecutive lines is obtained by means of partial knitting. In partial knitting, a group of loops is formed by knitting, while other loops are held in a non-knit position. Partial knitting may be performed by a knitting machine programmed accordingly. Partial knitting provides the eyelets of the shoe upper directly during knitting as integrated structures.

Figure 2A:
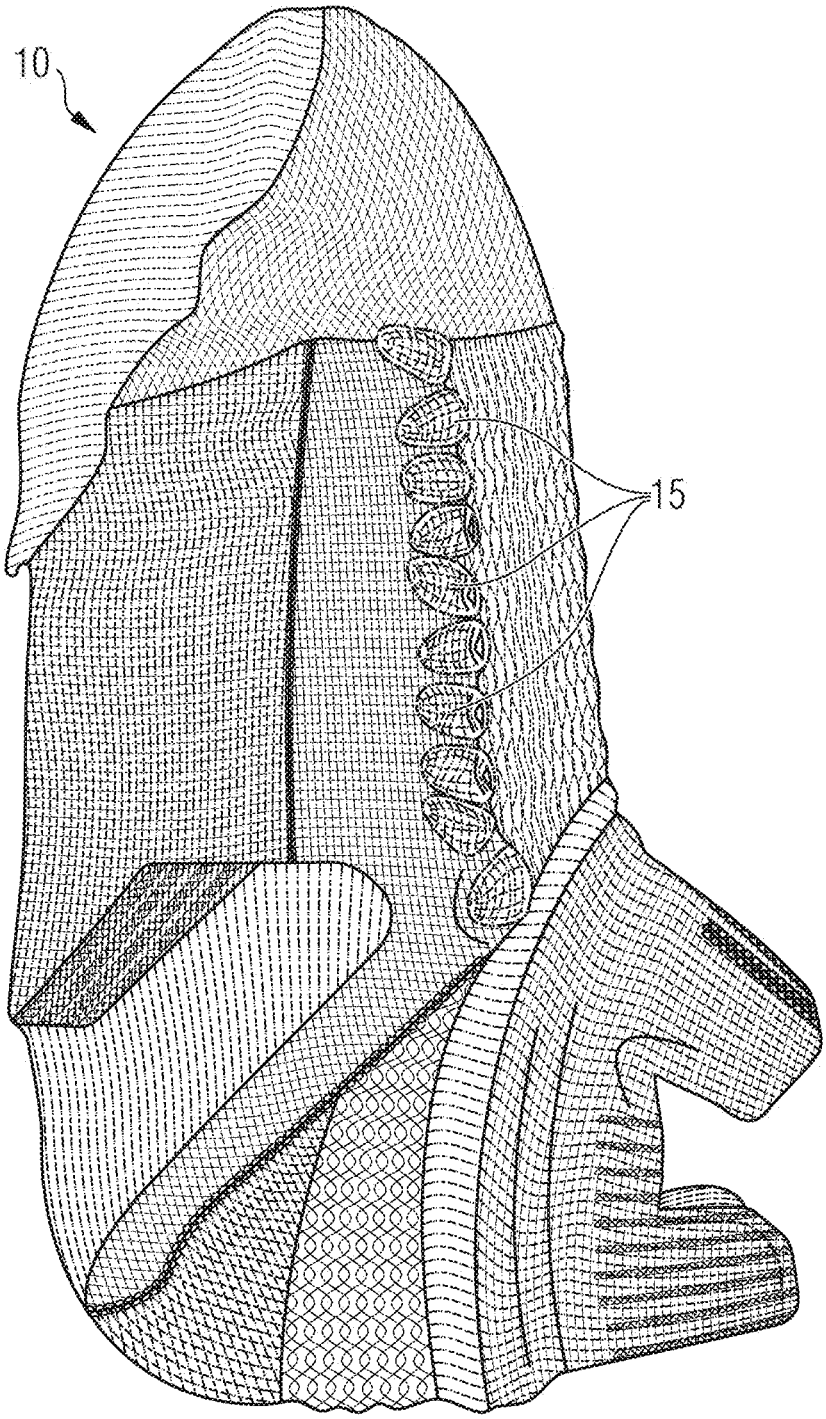
FIGS. 2A and 2B show another embodiment of a shoe upper 10 according to the present invention.
Figure 2B:
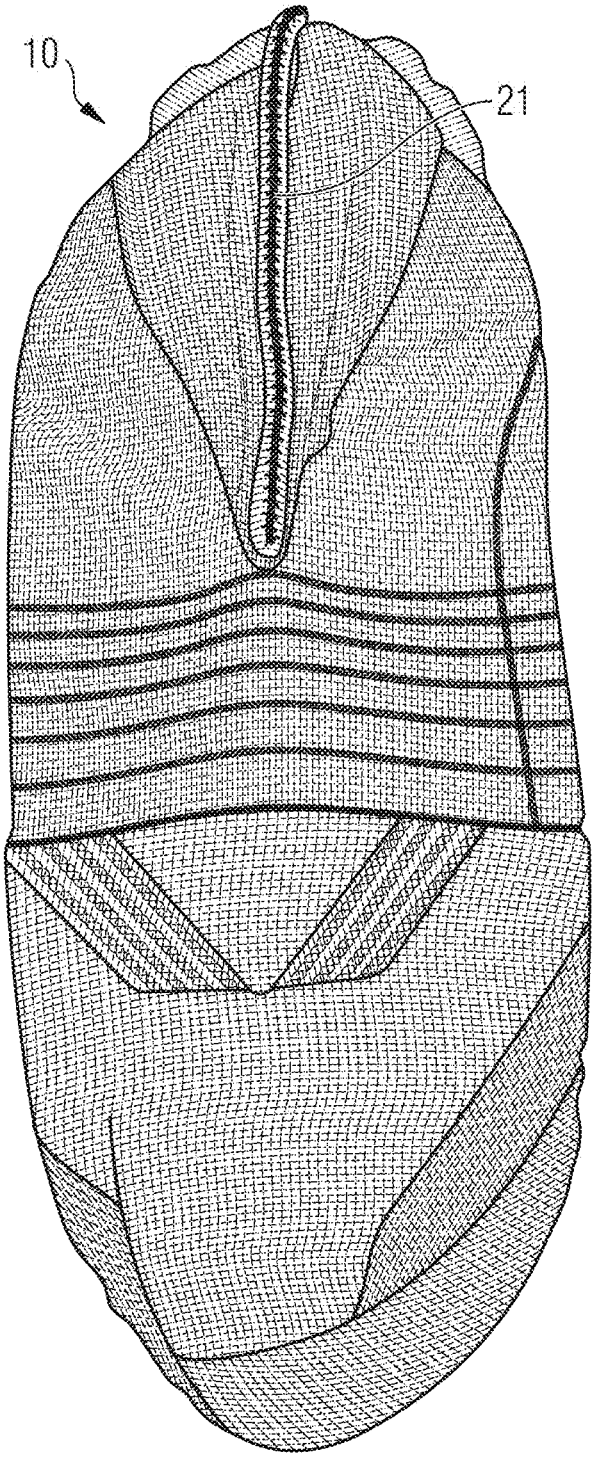

FIGS. 2A and 2B show a similar embodiment of a shoe upper 10 as FIGS. 1A and 1B. The shoe upper 10 is a sock-in-sock construction, wherein in the embodiment of FIGS. 2A and 2B the socks have been placed one into the other, in particular by placing the inner sock inside the outer sock. As shown in FIG. 2B, the openings at the respective free ends of the inner and outer sock are closed by a longitudinal seam 21 on the bottom of the socks, i.e. in a sole area.

Figure 3A:
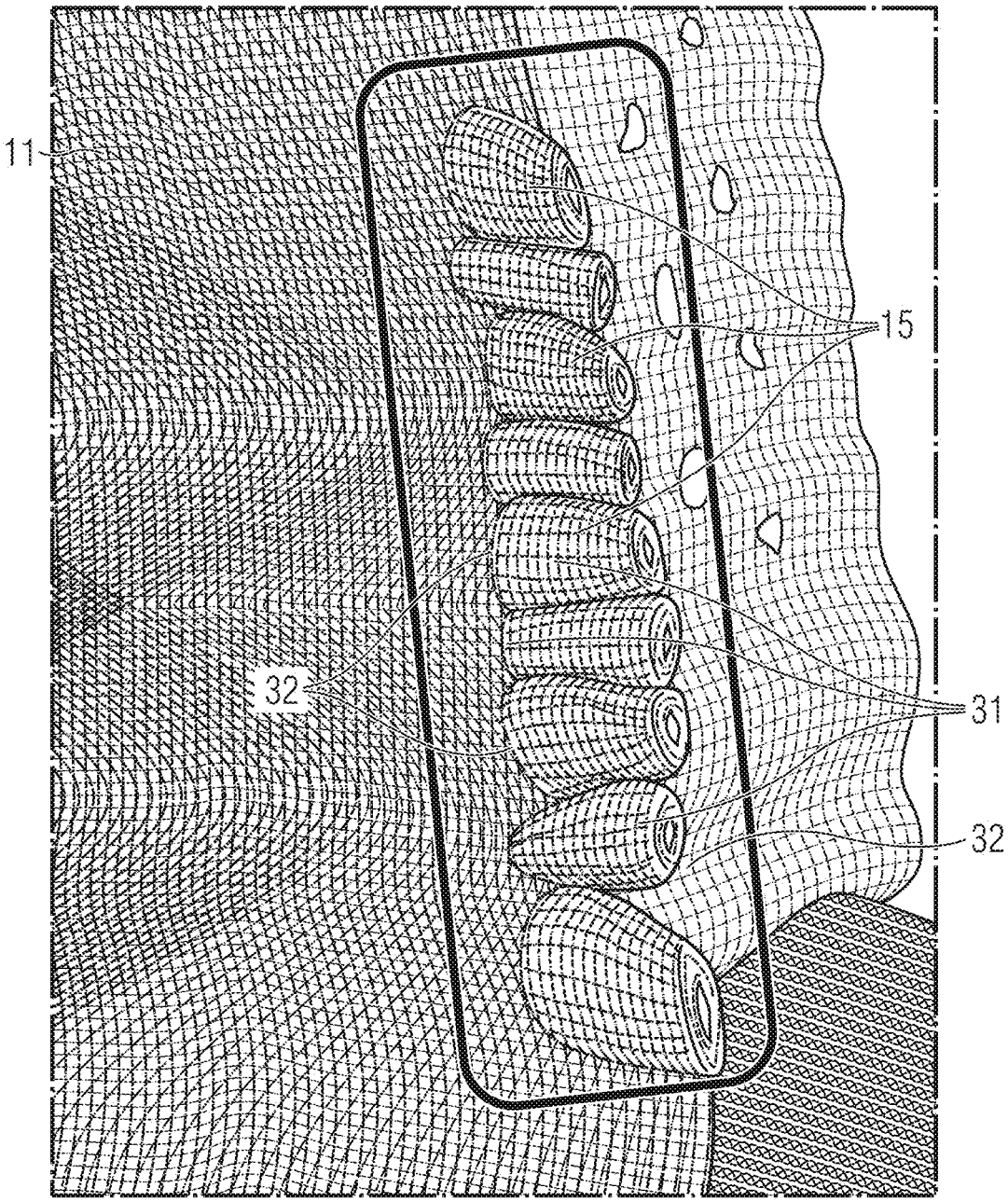
FIGS. 3A and 3B show details of the construction of eyelets according to the present invention.
Figure 3B:
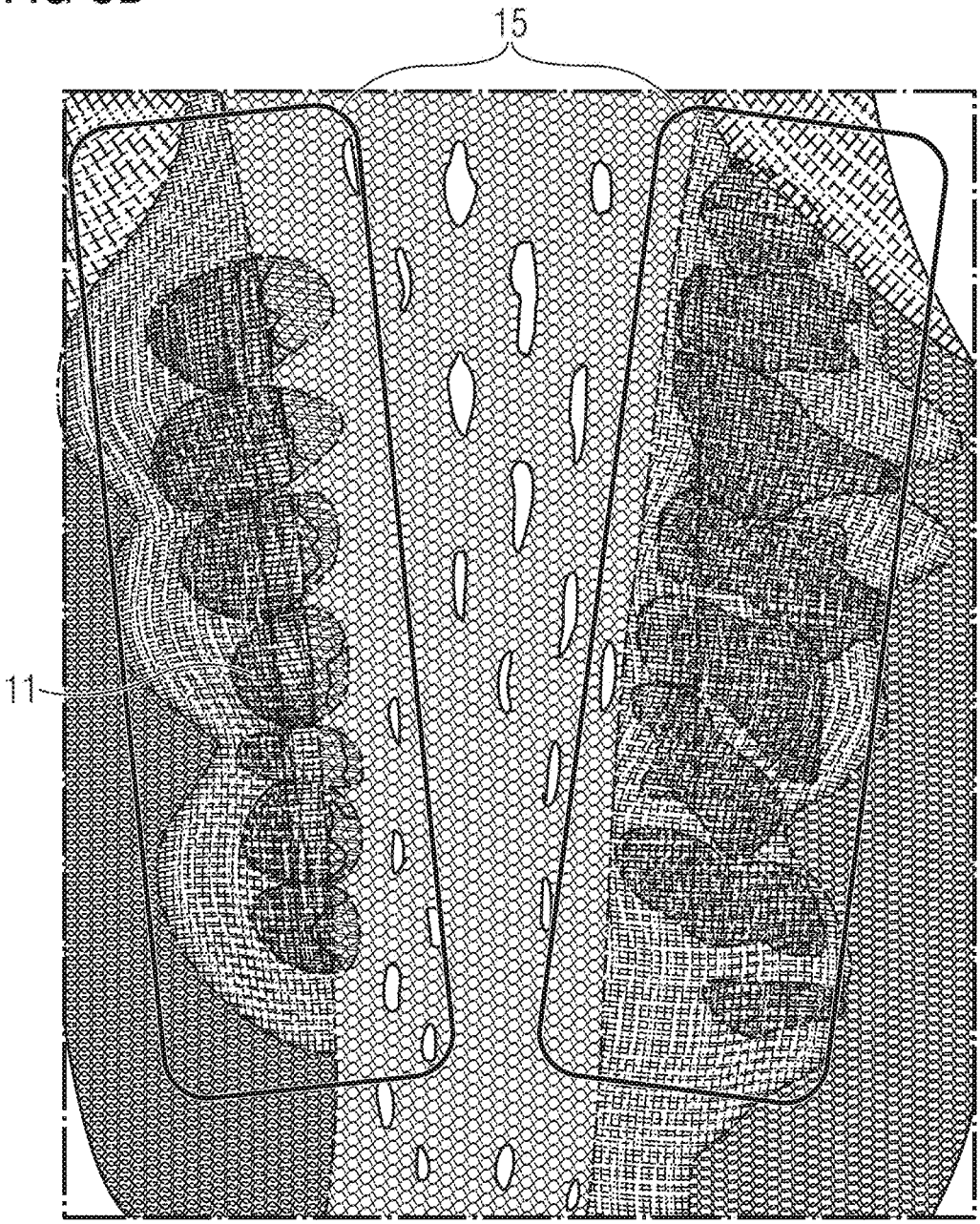

FIGS. 3A and 3B show details of the construction of the eyelets 15 according to the present invention, wherein FIG. 3A shows the front side of a single-jersey knitted component 11 and FIG. 3B shows the back side of the single-jersey knitted component 11, wherein the two areas of the eyelets 15 on the front side are emphasized by the rectangles 31. As shown in FIG. 3A, the eyelets 15 are formed by lines of loops. Three of those lines are exemplarily denoted by the reference numeral 31. The loops of those lines 31 are interlooped with loops of the respective line, but also with loops of adjacent lines 31 pertaining to the set of consecutive lines. The lines of loops making up an eyelet 15 form a set of consecutive lines. The knitted component 11 also comprises other lines of loops which are not contained in this set. Three of those lines have been exemplarily denoted by the reference numeral 32. The lines 31 in the set of consecutive lines of loops making up an eyelet 15 are not interlooped with the lines 32. In this way, two apertures are created at the sides of the eyelet 15 through which a lace may be threaded.

Figure 4A:
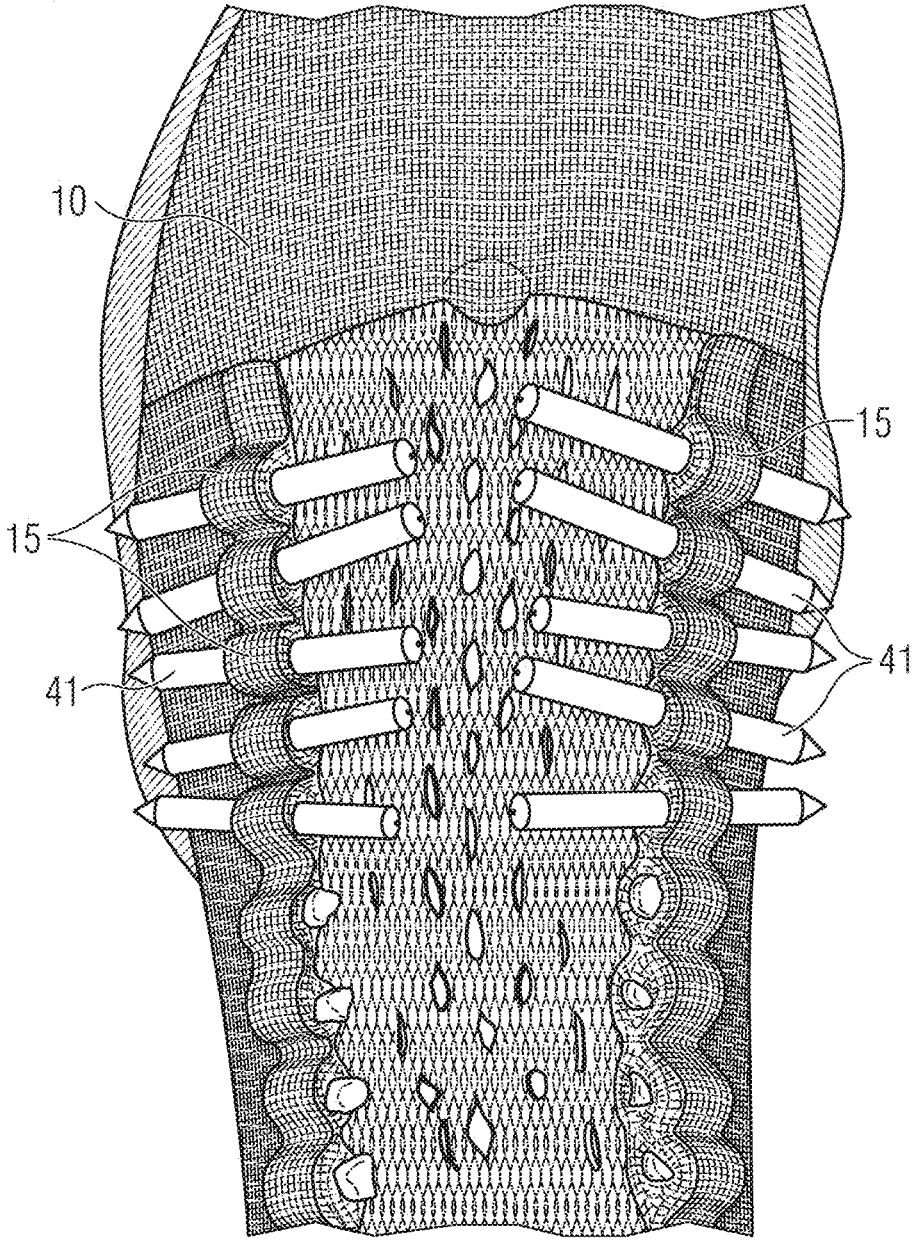
FIG. 4A shows the usage of pins to stabilize the eyelets.

To provide stability to the eyelets 15, a fusible yarn may be located in the lines of the set of consecutive lines of loops making up an eyelet 15. To activate the fusible yarn, the shoe upper 10 is heat set by placing it for example in a steaming box at a temperature of about 100° C. To stabilize the eyelets during heat setting, pins may be placed inside the eyelets 15 formed by the set of consecutive lines of loops. This is shown in FIG. 4A, where three of those pins are exemplarily denoted by the reference numeral 41. The pins 41 may be made from metal or any other material that is able to resist the heat during heat setting of the upper and especially the fusible yarn. In a preferred embodiment, pins 41 have a length of 52 mm and a diameter of 5 mm.

Figure 4B:
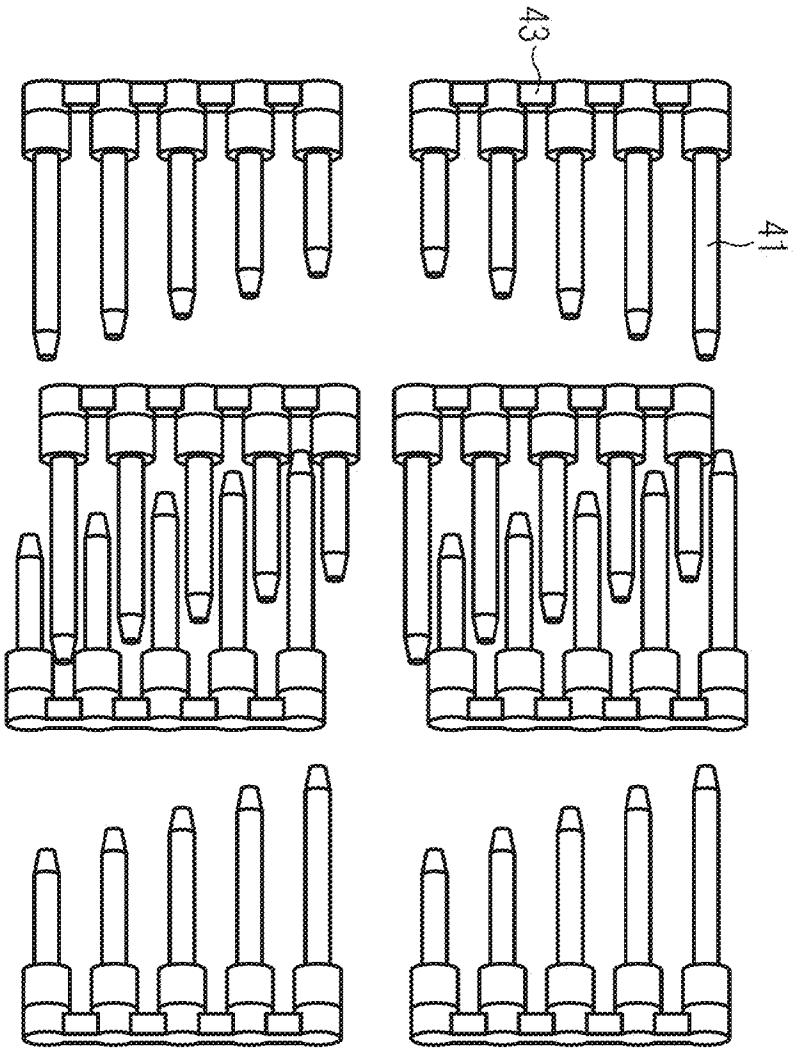
FIG. 4B shows an alternative embodiment to the embodiment of FIG. 4A.

FIG. 4B depicts an alternative embodiment of the pins shown in FIG. 4A. The pins in the example have different lengths and are provided in corresponding holders 43.

Figure 4C:
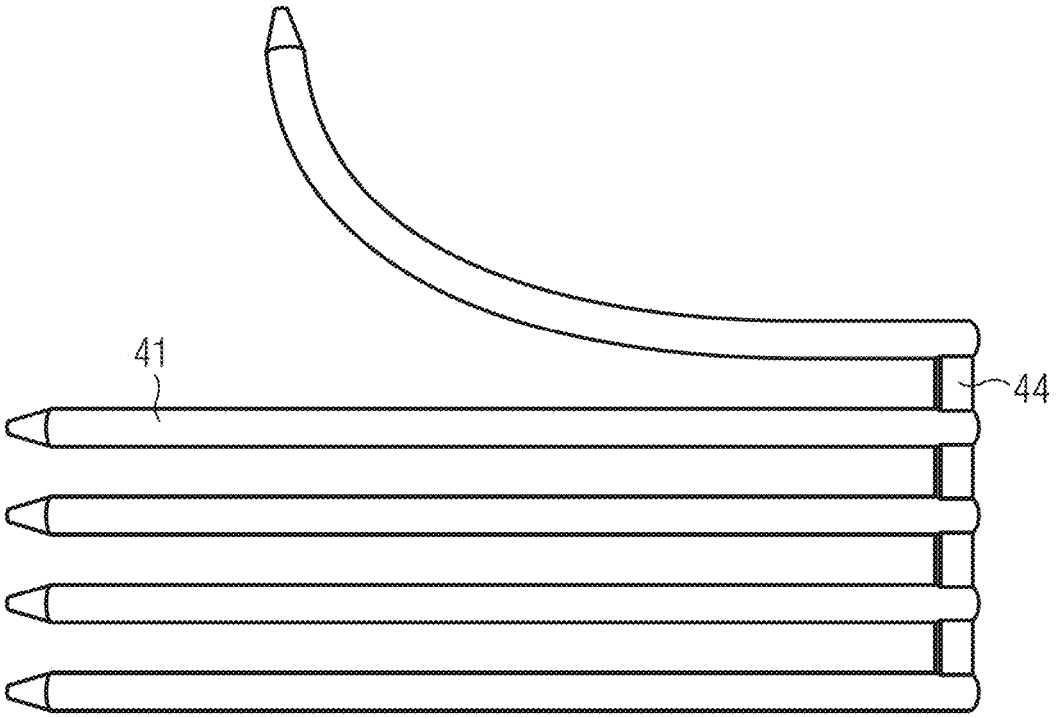
FIG. 4C shows another alternative embodiment to the embodiments of FIGS. 4A and 4B.

FIG. 4C depicts yet another embodiment of pins 41 which is presently preferred. The pins 41 in this example are made from a soft material. The soft material allows each pin 41 (or finger) to be flexible and bend, to be easily inserted in each eyelet and to adapt to each eyelet. The pins 41 are long enough to be placed through both sets of lace holes (on the lateral and medial sides). In the exemplary embodiment, five pins are connected by a common base 44. Therefore, for example, only two of these constructions are needed for one shoe. Of course, in other embodiments, a different number of pins 41 may be provided on a common base.

Figure 4D:
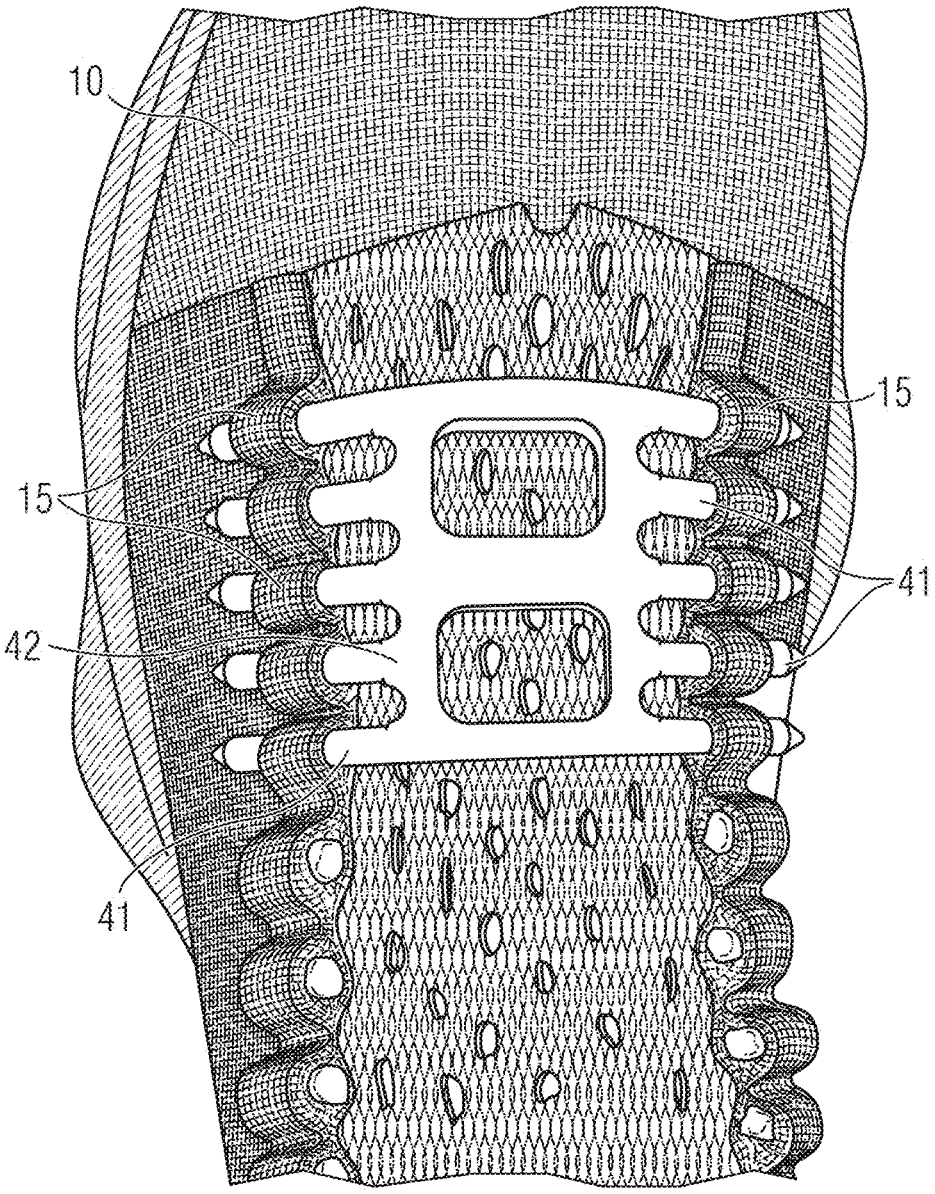
FIG. 4D shows the usage of a comb- or spider-like construction to stabilize the eyelets.
Figure 5A:
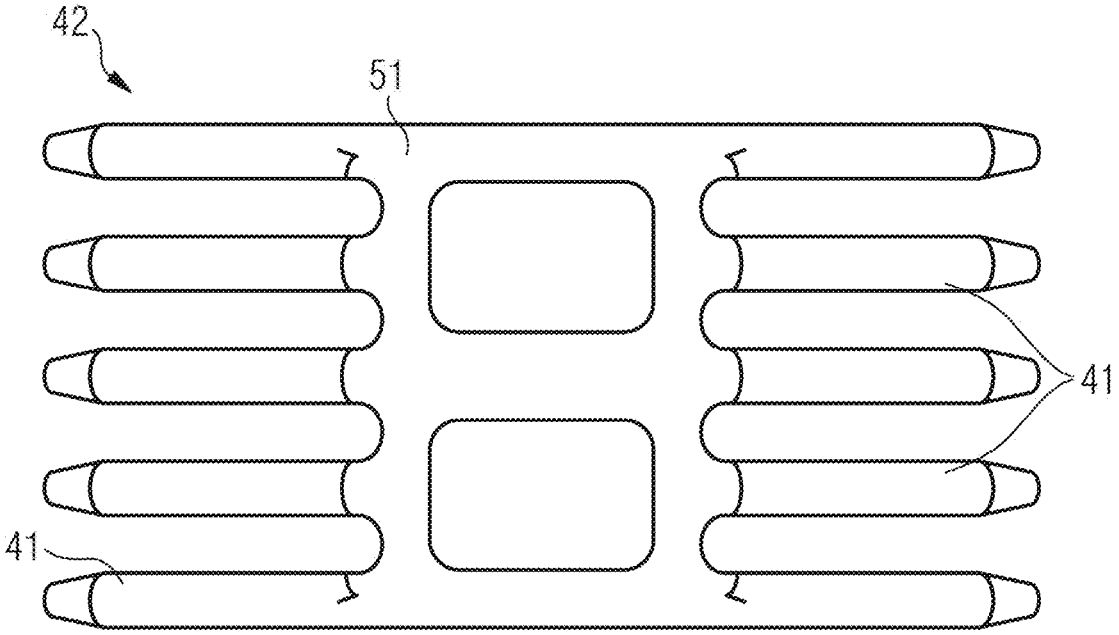
FIGS. 5A, 5B and 5C show the construction used in the example of FIG. 4D in more detail.
Figure 5B:
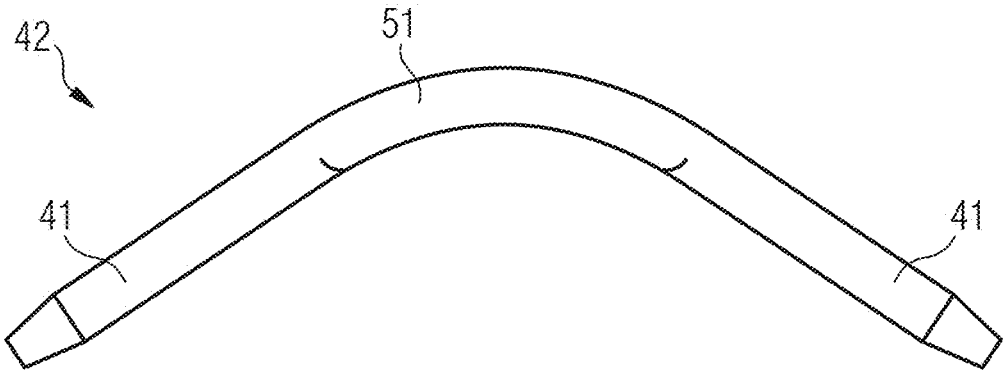
Figure 5C:
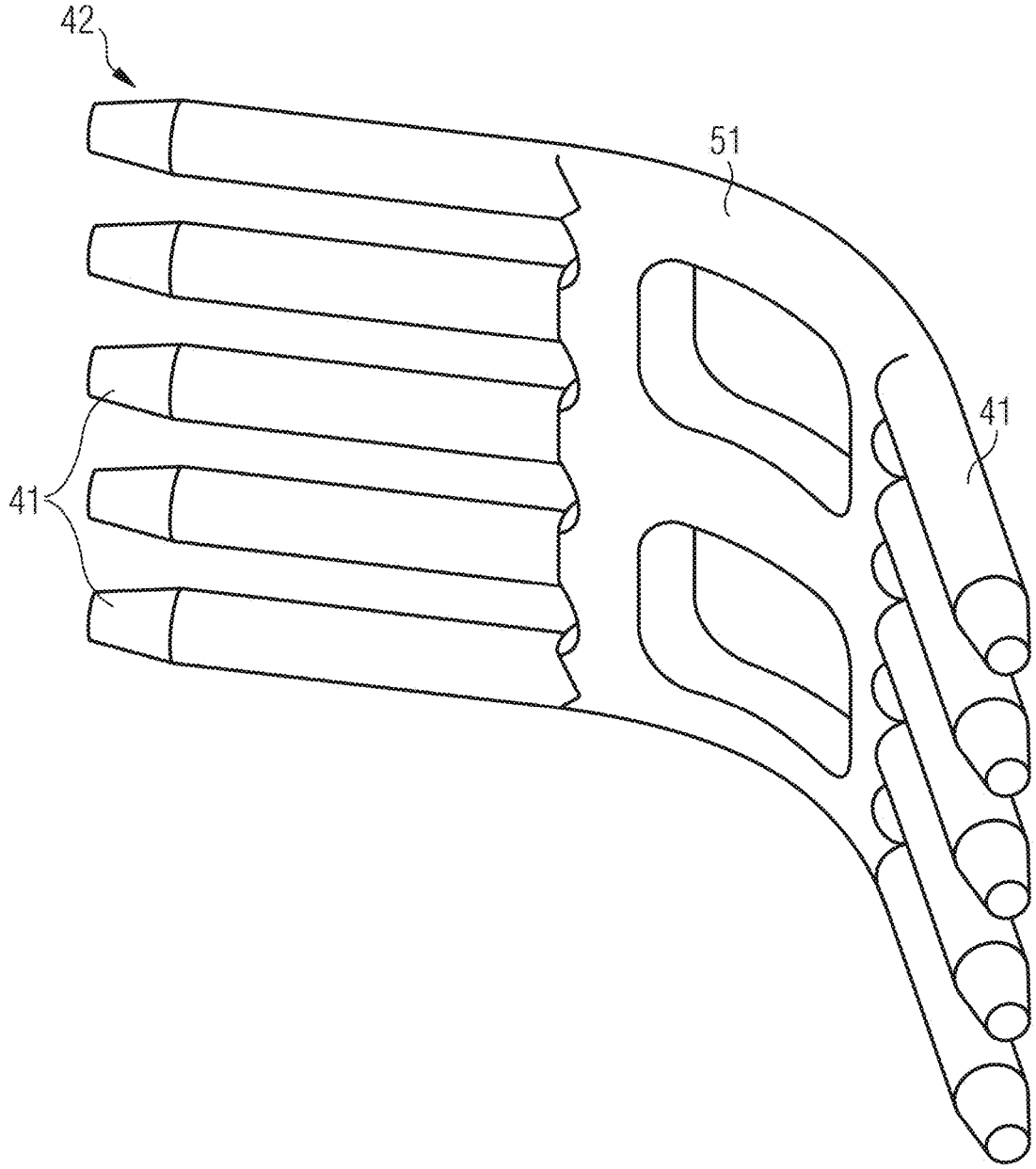

In an alternative embodiment depicted in FIG. 4D a comb- or spider-like construction 42 is used to stabilize the eyelets 15 during heat setting. This constructions in depicted in more detail in FIGS. 5A, 5B and 5C, wherein FIG. 5A shows a front view, FIG. 5B shows a side view and FIG. 5C shows an oblique view. The construction 42 comprises a main body 51 from which pins 41 project. The construction allows insertion of multiple pins 41 into corresponding eyelets 15 at the same time and in a single step. The construction 42 may be obtained by a 3D-printing process.

Figure 6A:
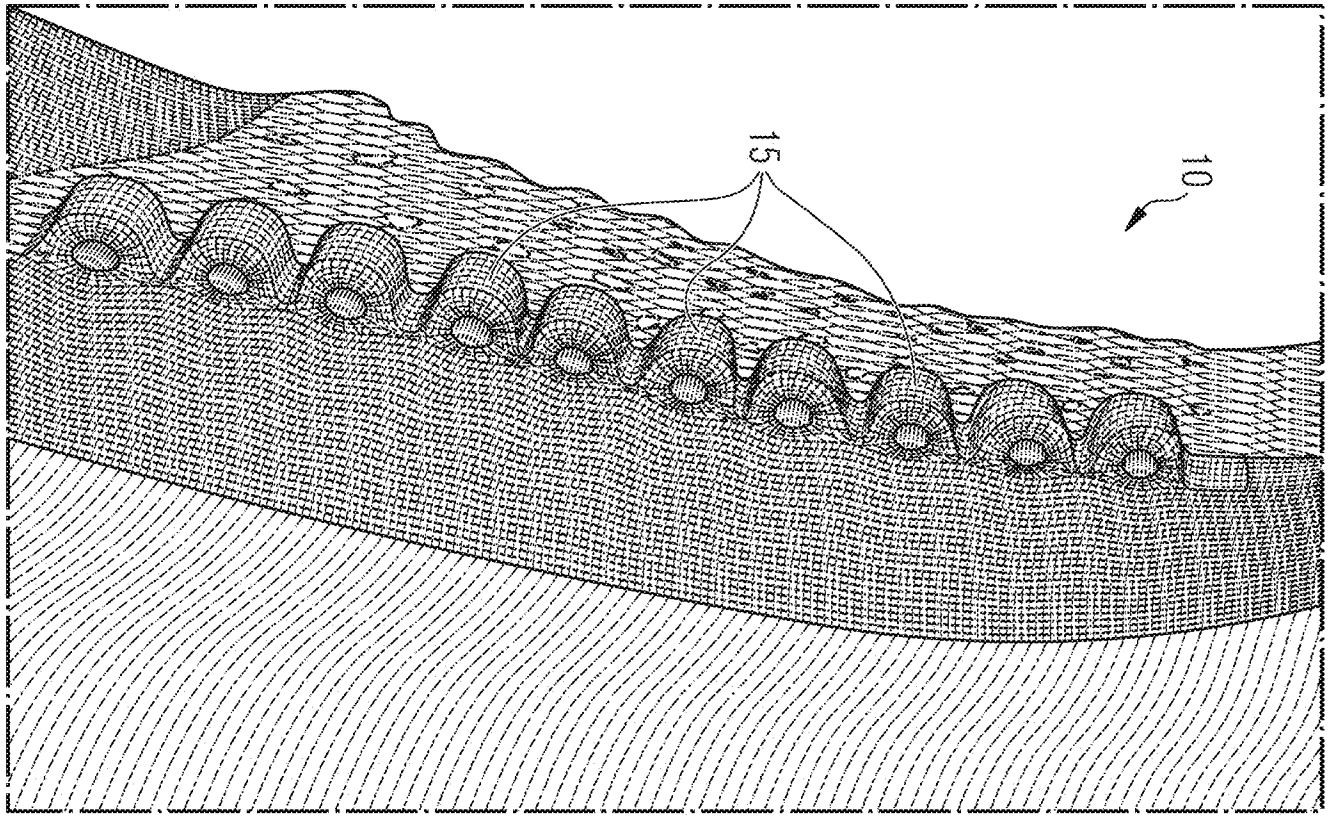
FIGS. 6A and 6B show the usage of elastic yarn in the eyelets according to the present invention.
Figure 6B:
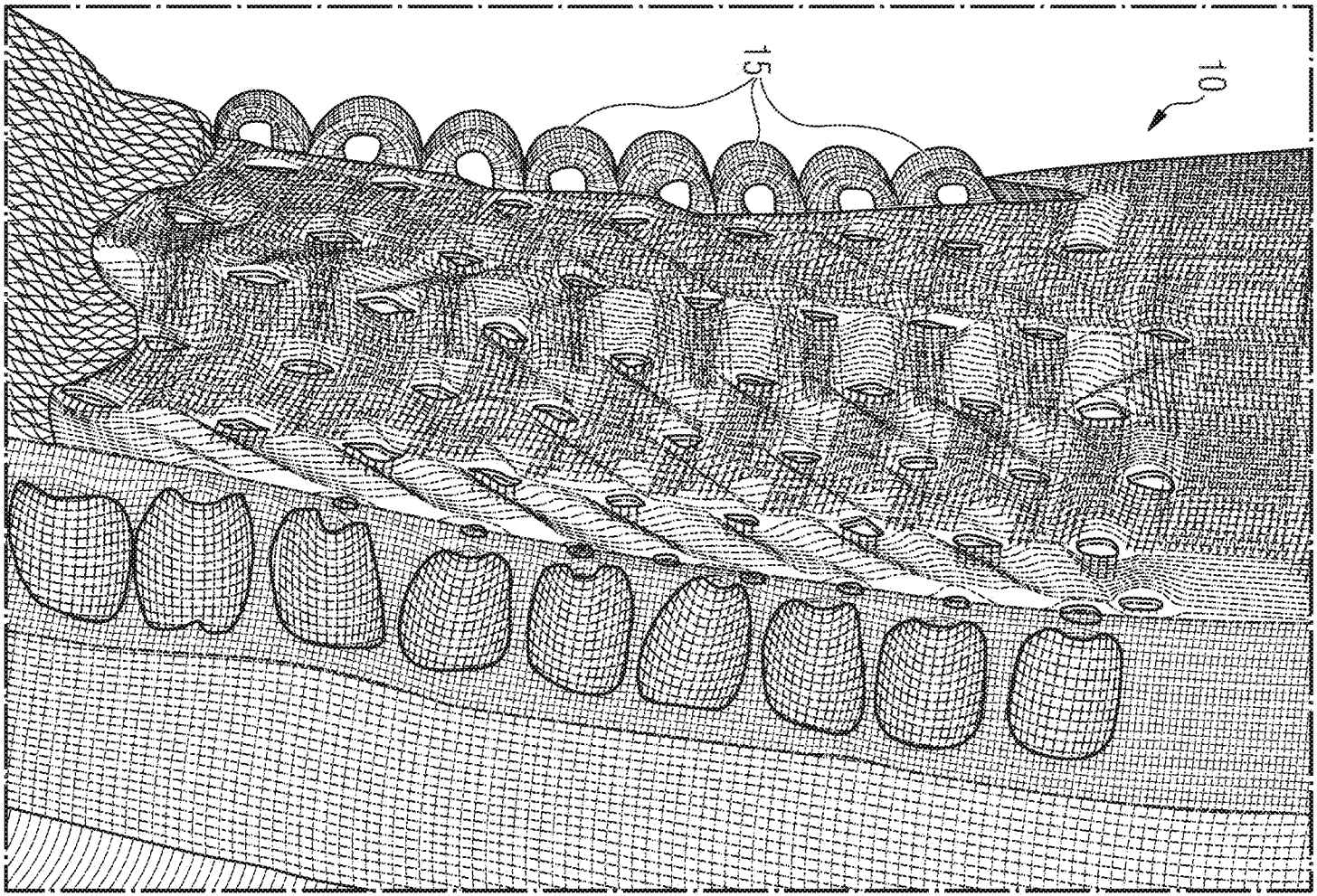

FIGS. 6A and 6B show an embodiment of a shoe upper 10 according to the invention, wherein an elastic yarn has been added to the eyelets 15. In this embodiment, the eyelets 15 do not comprise a fusible yarn. The elastic yarn is sufficient to stabilize eyelets even when heat setting the shoe upper 10 to stabilize the shape of the shoe upper 10. No specific heat setting steps for fusing fusible yarn on the eyelets 15 is needed in this case. Also, it is not required to place pins in the eyelets 15 during heat setting.

Figure 7A:
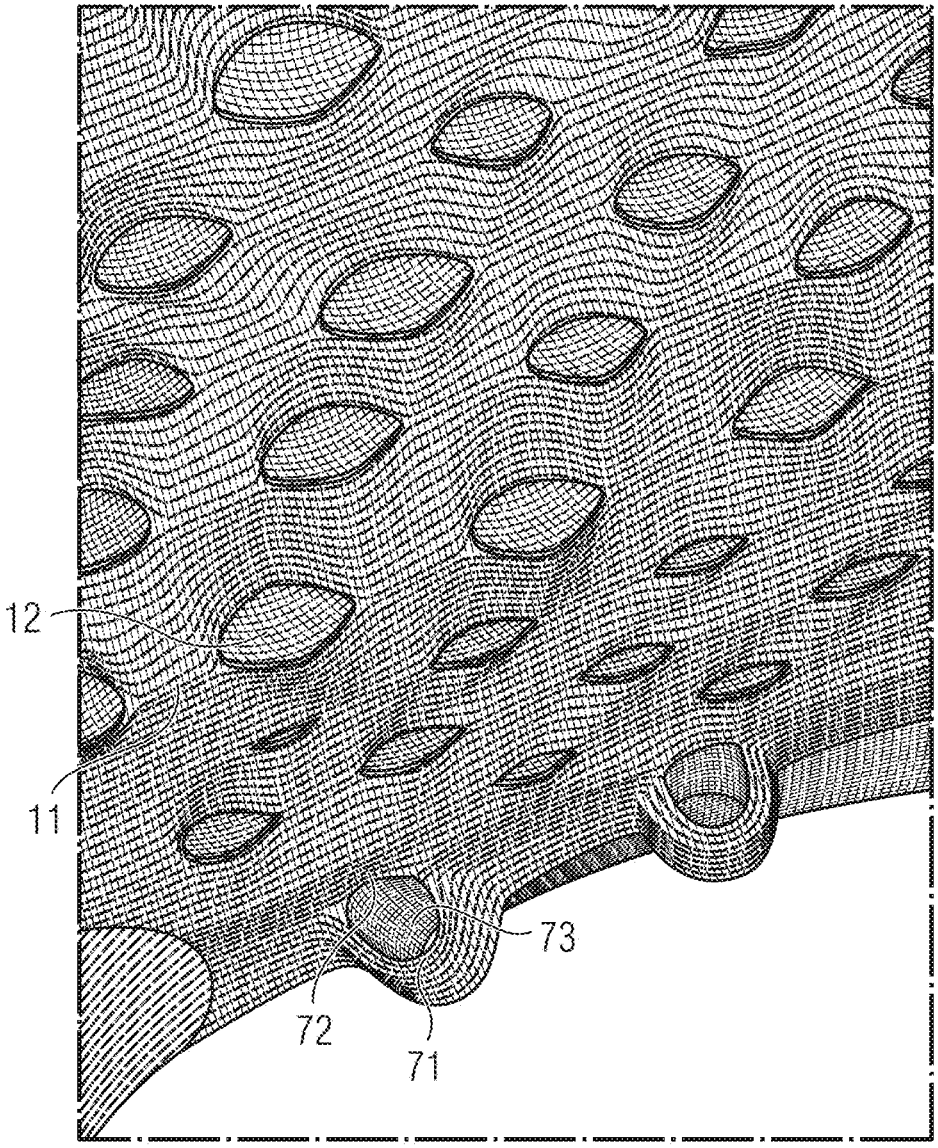
FIGS. 7A and 7B show details of eyelets according to the present invention.
Figure 7B:
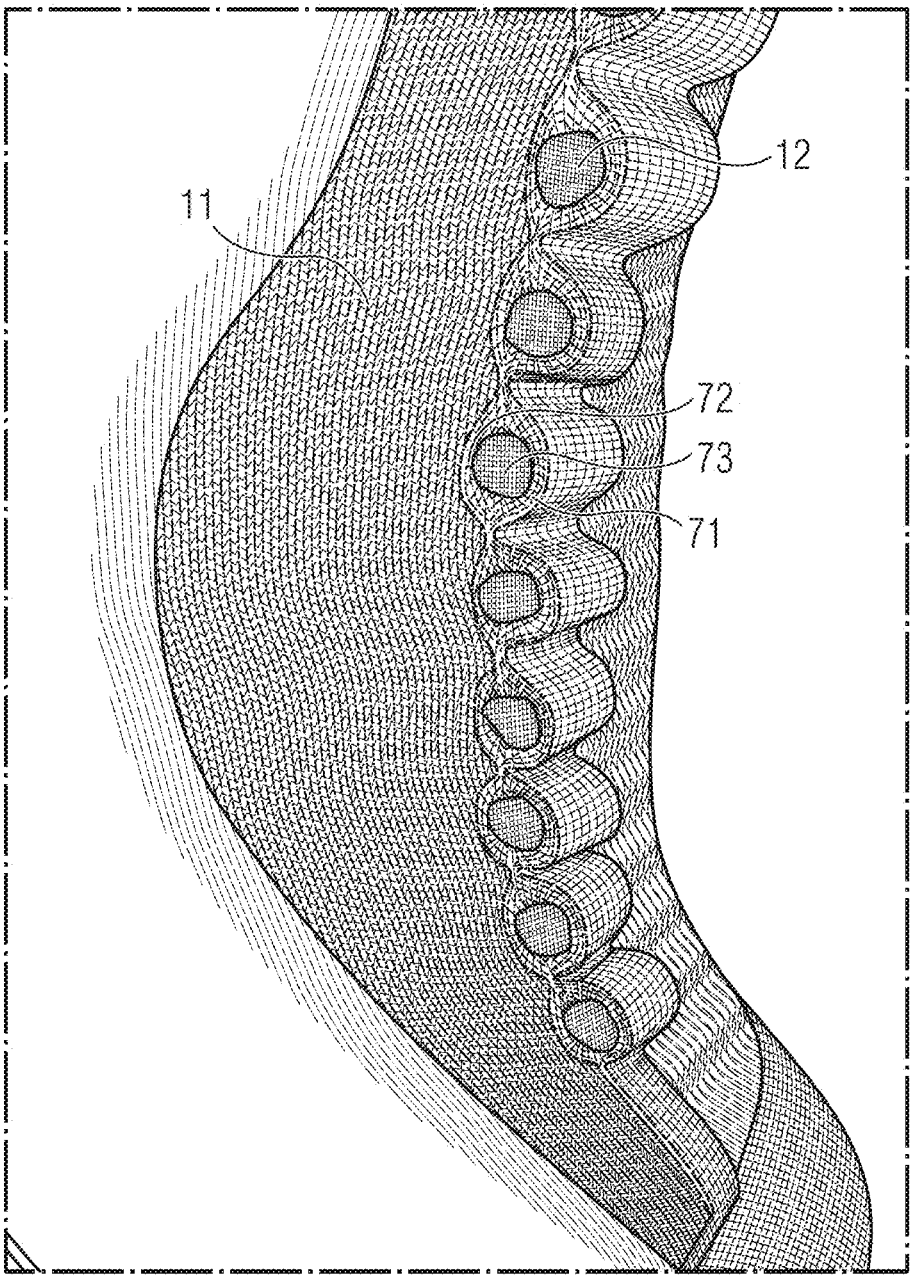

FIGS. 7A and 7B show details of the eyelets 15 of shoe uppers according to the present invention. The set of consecutive lines of loops making up an eyelet 15 comprises a first line 71. The loops of this line are interlooped with corresponding loops of an adjacent line of the set, but not interlooped with loops of an adjacent line 72 not contained in the set. In this way, an aperture 73 is created through which a lace may be threaded. The eyelet 15 comprises a similar aperture on the opposite side. The shoe uppers depicted in FIGS. 7A and 7B are based on a sock-in-sock construction as described above. The outer layer 11 covers the inner layer 12. In the exemplary embodiment of FIG. 7A, the outer layer 11 comprises a number of openings through which the inner layer 12 is visible.

FIGS. 8A, 8B, 8C and 8D show an embodiment of a shoe 80 according to the invention. The shoe comprises a shoe upper 10 according to the invention as described herein and a sole structure 81 attached to the shoe upper 10.

The sole structure 81 is attached to the shoe upper 10 by direct injecting PU sole material onto shoe upper 10. Other means of attaching the sole 81 to the upper 10 in the context of the present invention are of course possible.

Figure 8A:
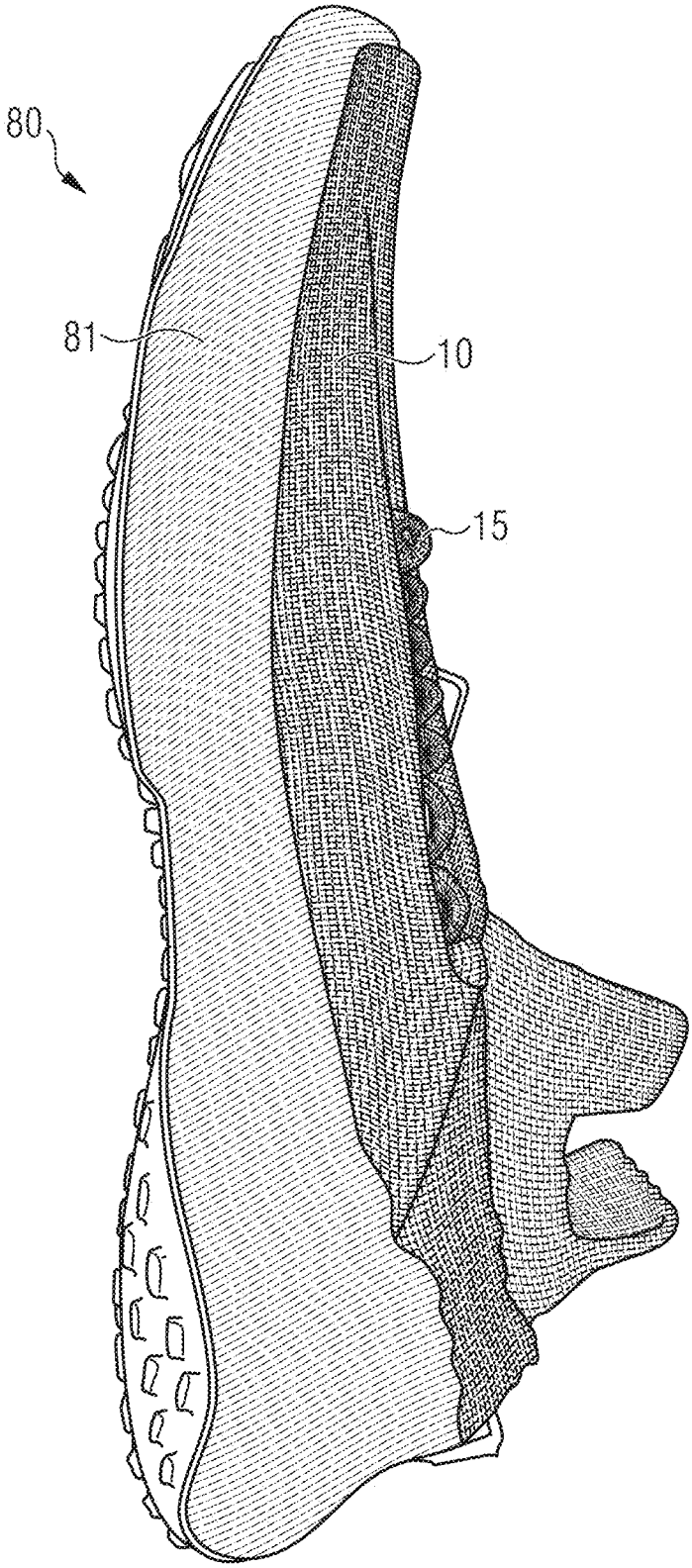
FIGS. 8A, 8B, 8C and 8D show an embodiment of a shoe according to the present invention.
Figure 8B:
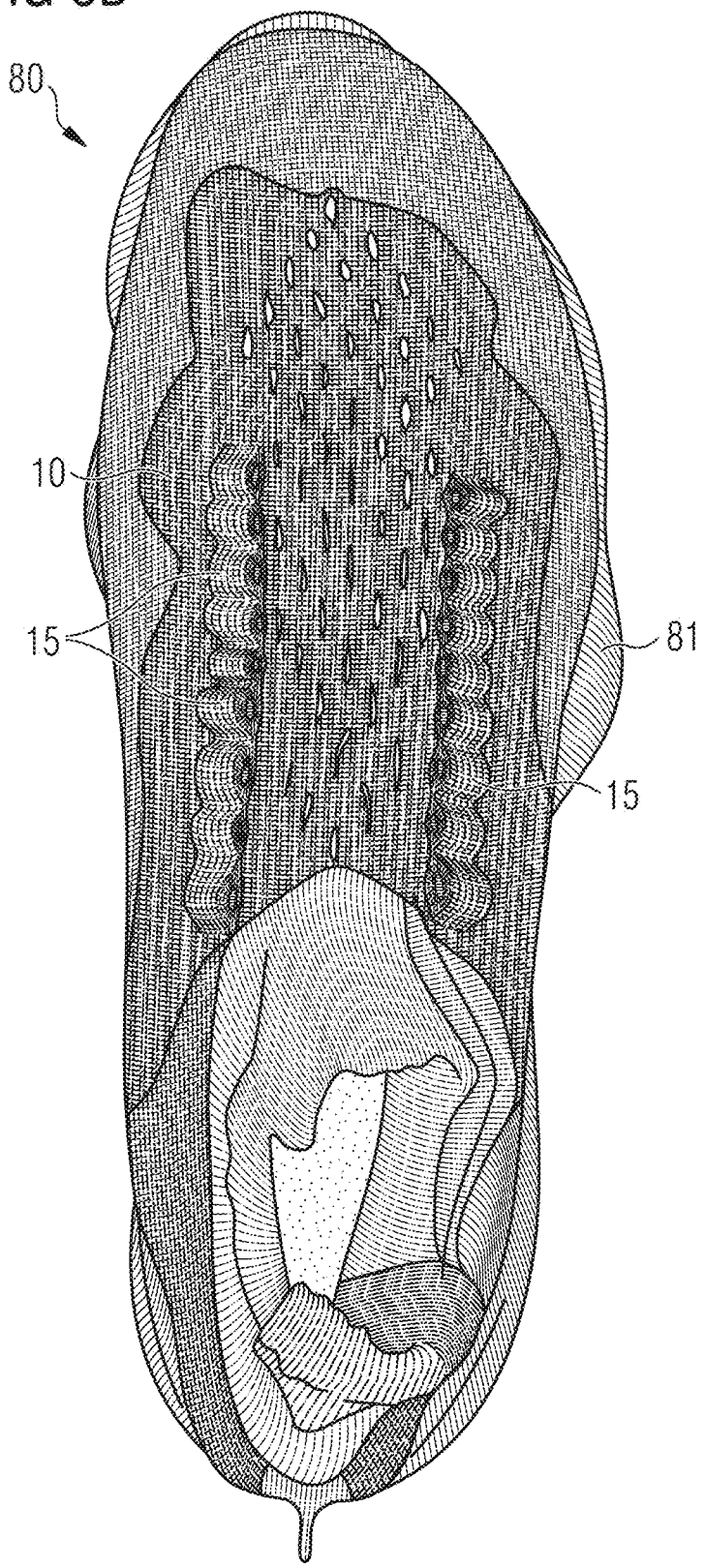
Figure 8C:
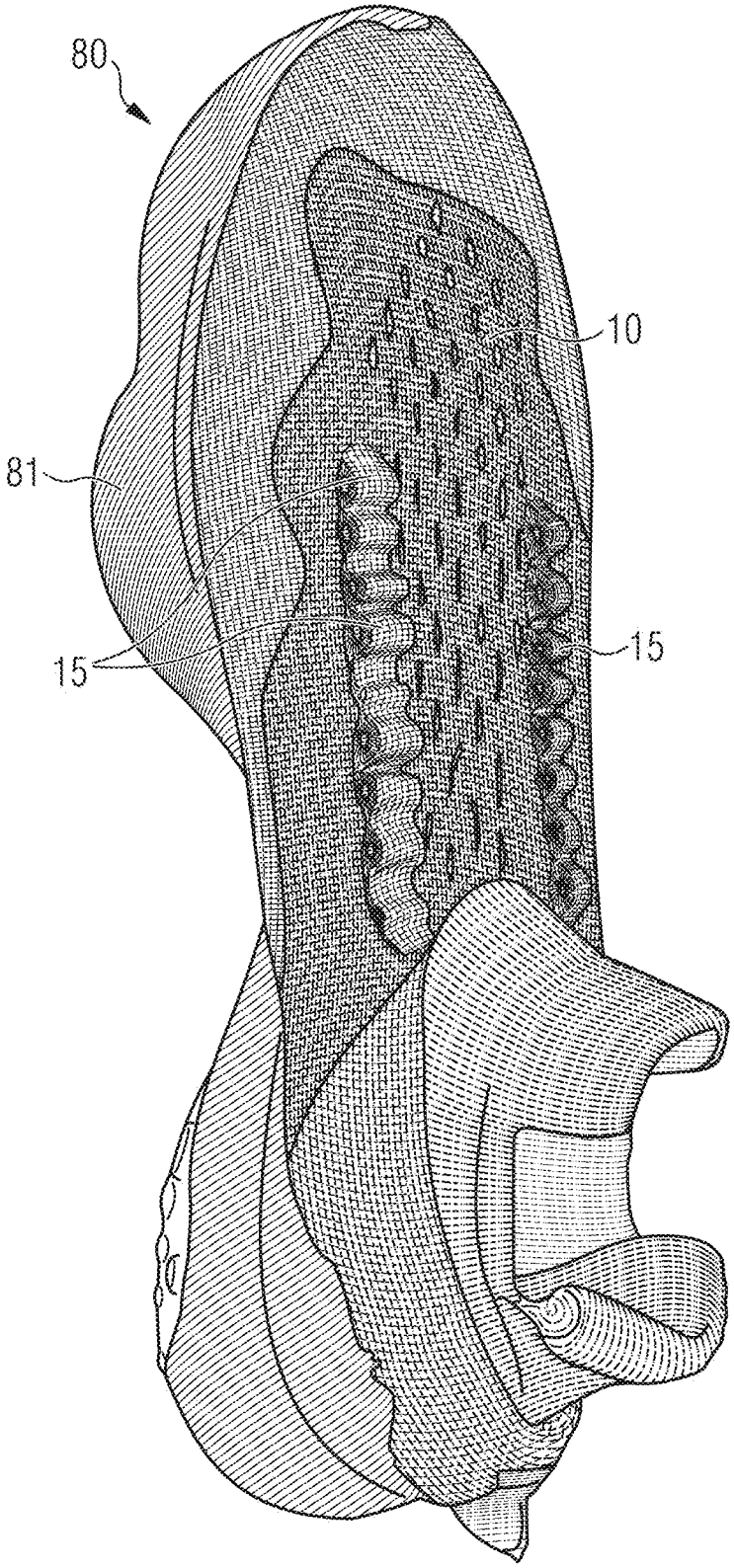
Figure 8D:
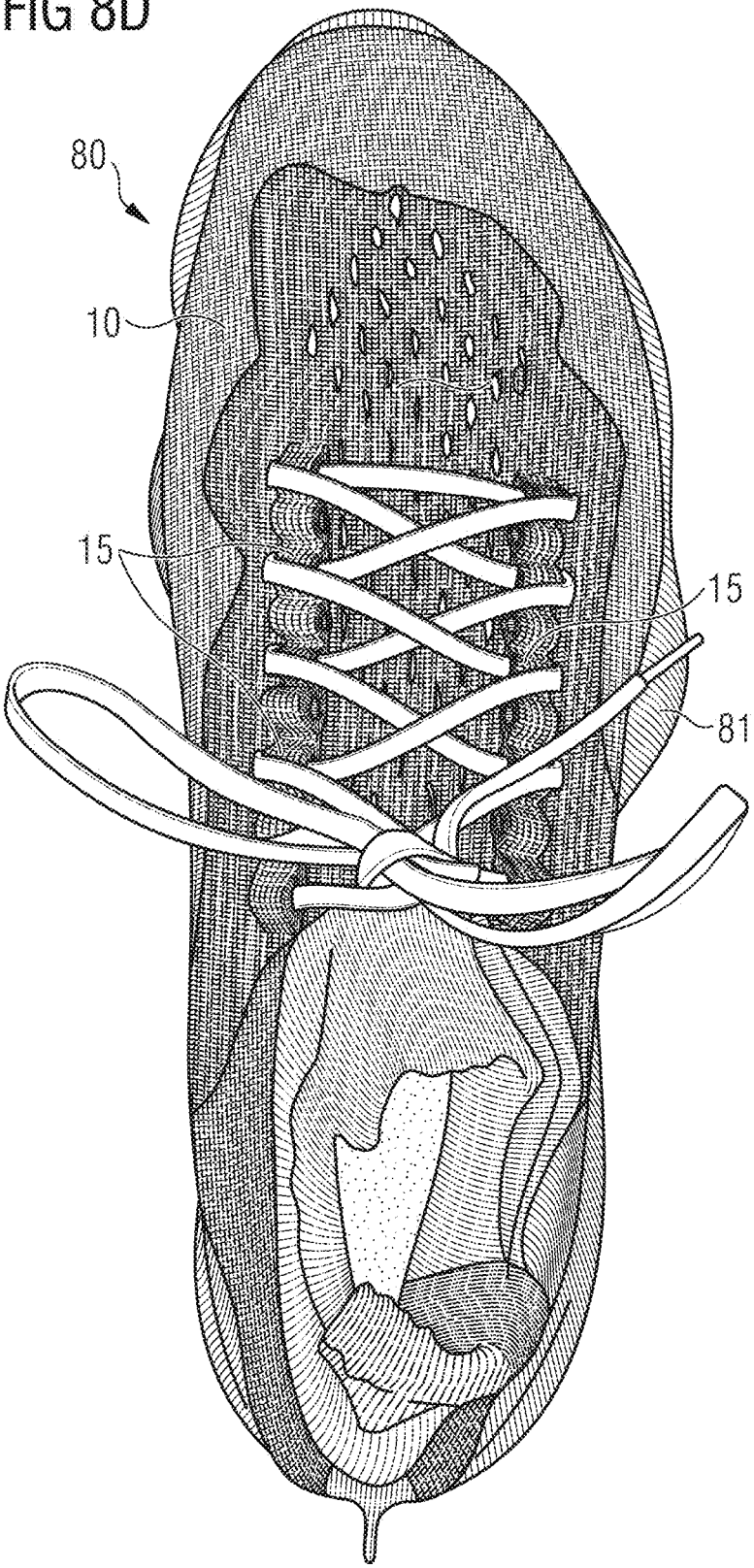

The shoe upper 10 comprises a knit element comprising a number of eyelets 15 formed by a set of lines of loops comprising a set of consecutive lines, wherein each line in the set of consecutive lines comprises a plurality of consecutive loops which are interlooped with adjacent loops of the respective line and not interlooped with loops of a line which is not contained in the set. As shown in FIG. 8D, the eyelets 15 are configured to receive a lace 16.

Figure 9:
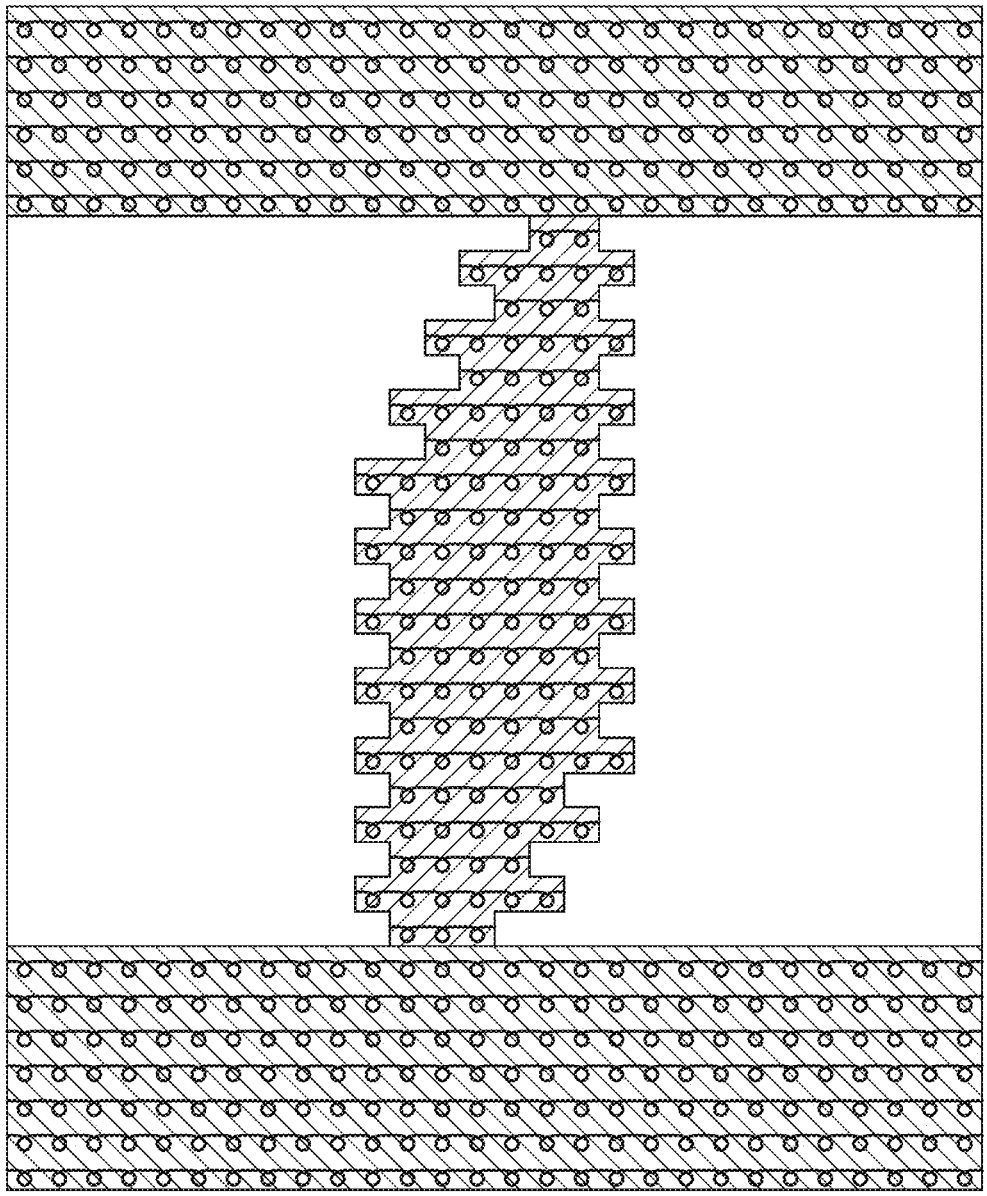
FIG. 9 shows an exemplary knitting sequence to create an eyelet according to the present invention.

FIG. 9 shows an exemplary knitting sequence to obtain eyelets 15 in a knitted component as described herein. The knitting sequence can be provided to a knitting machine as a suitable program and the eyelets 15 can be obtained by partial knitting.

Figure 10A:
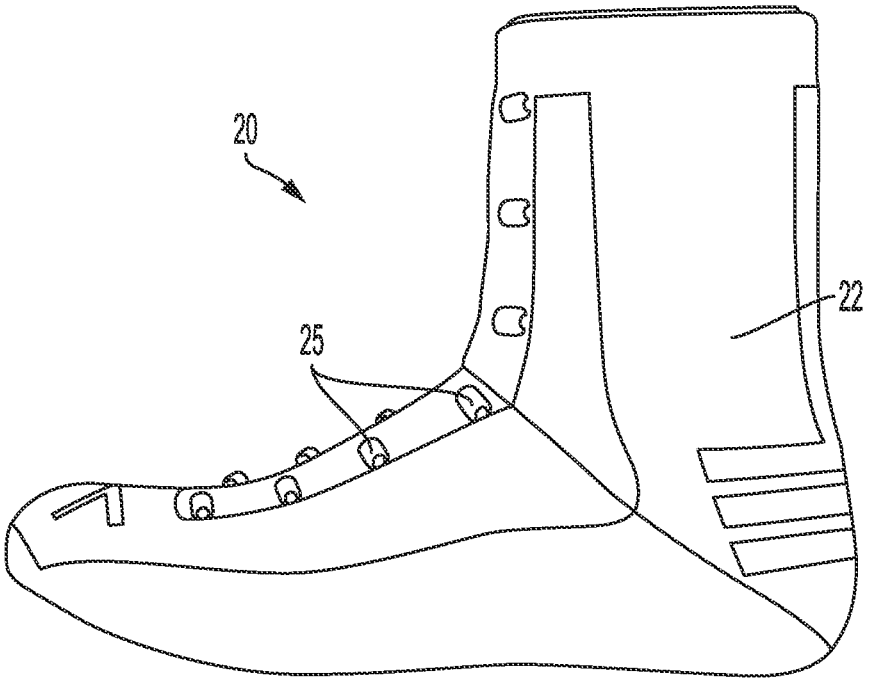
FIG. 10A shows a side view of a shoe having eyelets according to an embodiment of the present invention.
Figure 10B:
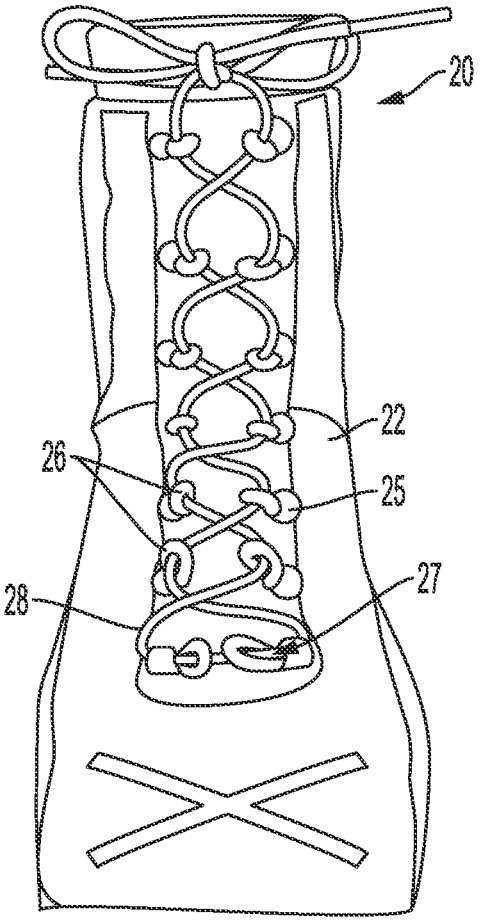
FIG. 10B shows a front view of the shoe of FIG. 10A having lace loops and a shoe lace according to an embodiment.

FIGS. 10A and 10B show a shoe upper 20 having a double-layer construction with an inner knitted layer and an outer knitted layer 22. The inner and outer knitted layers may have a unitary knit construction and may be knit together. The inner and outer knitted layers are connected to one another at least at a collar region of the shoe upper as described herein (see, e.g., FIGS. 1A and 1B). The outer knitted layer 22 may be put over the inner knitted layer or the inner knitted layer may be inserted into the outer knitted layer 22 to provide a shoe having a double-layer construction.

In some embodiments, the inner knitted layer and the outer knitted layer may overlap in the area of the set of consecutive lines of loops. The inner knitted layer and the outer knitted layer may not be connected in the area of the set of consecutive lines of loops. In some embodiments, inner knitted layer and the outer knitted layer may overlap in an area of an instep of the shoe upper and may not be connected in the area of the instep.

The outer knitted layer 22 may include one or more eyelets 25. Eyelets 25 may be formed as described above with respect to eyelets 15. Each eyelet 25 may be configured to receive a lace loop 26. The lace loop 26 extends from the inner knitted layer through the eyelet 25 of the outer knitted layer 22 so that the lace loop 26 is exposed on an exterior of the outer knitted layer 22. The lace loop 26 is configured to receive a lace 28. The lace loop 26 defines an aperture 27 configured to receive the lace 28 therethrough. The lace 28 extends through lace loops 26 rather than through the eyelets 25.

The lace loop 26 may be knitted in a similar manner as the eyelet 25 of the outer knitted layer 22. However, the lace loop 26 is knitted in the inner knitted layer. The length of the lace loop 26 may be greater than a length of the eyelet 25 of the outer knitted layer 22 such that the lace loops 26 may extend out from and beyond the eyelet 25. The knitted lace loops 26 form a knitted in double-loop lacing system that provides a uniformly distributed pulling strength that is distributed over the whole shoe upper. The knitted lace loops 26 provide an increase in tensile strength while relieving pressure on the foot. As a result, greater comfort is achieved. The knitted lace loops 26 further provide flexibility in choosing the directions in which the lacing system can be arranged.

Some embodiments described herein relate to a shoe upper comprising a knitted component comprising a plurality of integrally knitted lines of loops comprising a set of consecutive lines, wherein each line in the set of consecutive lines comprises a plurality of consecutive loops which are interlooped with adjacent loops of the respective line and are not interlooped with loops of a line which is not contained in the set, and wherein the set of consecutive lines forms at least a portion of an eyelet which is configured to receive a lace.

In any of the various embodiments described herein, the set of consecutive lines may be knitted by means of partial knitting.

In any of the various embodiments described herein, the lines of the set of consecutive lines may be wales.

In any of the various embodiments described herein, the eyelet may have a width between 5 mm and 15 mm.

In any of the various embodiments described herein, the set of consecutive lines may comprise 2 to 10 lines.

In any of the various embodiments described herein, the lines in the set of consecutive lines of loops may have a length between 10 mm and 30 mm.

In any of the various embodiments described herein, each line in the set of consecutive lines of loops may comprise 15 to 25 loops.

In any of the various embodiments described herein, the fusible yarn may be located only in the lines of the set of consecutive lines of loops.

In any of the various embodiments described herein, the fusible yarn may be selected from a polyester yarn, a polyamide yarn, and a urethane-based yarn.

In any of the various embodiments described herein, the knitted component may comprise at least one elastic yarn in the area of the set of consecutive lines of loops, and the elastic yarn is located only in the lines of the set of consecutive lines of loops. In some embodiments, the elastic yarn is more elastic than another yarn of the knitted component.

Some embodiments described herein relate to a shoe comprising a shoe upper as described herein, and a sole structure attached to the shoe upper.

Some embodiments described herein relate to a method of manufacturing a shoe upper, the method comprising providing a knitted component, providing the knitted component with a plurality of integrally knitted lines of loops comprising a set of consecutive lines, such that each line in the set of consecutive lines comprises a plurality of consecutive loops which are interlooped with adjacent loops of the respective line and are not interlooped with loops of a line which is not contained in the set, and forming the set of consecutive lines as at least a portion of an eyelet which is configured to receive a lace.

In any of the various embodiments described herein, the plurality of integrally knitted lines of loops may be wales.

In any of the various embodiments described herein, a first line in the set of consecutive lines may extend from a first end of the eyelet to a second end of the eyelet and comprises a first number of loops, and a second line not contained in the set may comprise all loops between a loop adjacent the first end of the eyelet and a loop adjacent the second end of the eyelet and comprises a second number of loops, wherein the first number is higher than the second number.

In any of the various embodiments described herein, the eyelet may have a width between 5 and 15 mm.

In any of the various embodiments described herein, the set of consecutive lines may comprise 2 to 10 lines.

In any of the various embodiments described herein, the lines in the set of consecutive lines of loops may have a length between 10 mm and 30 mm.

In any of the various embodiments described herein, each line in the set of consecutive lines of loops may comprise 15 to 25 loops.

In any of the various embodiments described herein, the number of loops of a line located between the first line and the last line in the set of consecutive lines of loops may be higher than the number of loops of the first and the last line.

In any of the various embodiments described herein, the method may further comprise arranging the fusible yarn only in the lines of the set of consecutive lines of loops.

In any of the various embodiments described herein, the fusible yarn may be selected from a polyester yarn, a polyamide yarn and a urethane-based yarn.

In any of the various embodiments described herein, the method may further include providing an inner knitted layer and an outer knitted layer in a unitary knit construction, connecting the inner knitted layer and the outer knitted layer at least in a collar region of the shoe upper, and putting the outer knitted layer over the inner knitted layer or inserting the inner knitted layer into the outer knitted layer to form the shoe upper. In some embodiments, the inner knitted layer and the outer knitted layer may overlap in the area of the set of consecutive lines of loops. In some embodiments, the inner knitted layer and the outer knitted layer may not be connected in the area of the set of consecutive lines of loops. In some embodiments, the inner knitted layer and the outer knitted layer may overlap in the area of the instep of the upper and may not be connected in the area of the instep.

In any of the various embodiments described herein, the method may further comprise the steps of providing at least one elastic yarn in the area of the set of consecutive lines of loops, and arranging the elastic yarn only in the lines of the set of consecutive lines of loops. In some embodiments, the elastic yarn is more elastic than another yarn of the knitted component.

In any of the various embodiments described herein, the method may further comprise using a small circular knitting machine for providing the knit component.

Some embodiments described herein relate to a shoe upper obtained by a method as described herein.

What is claimed is:

1. A shoe upper, comprising:

a knitted component, comprising:

a plurality of integrally knitted lines of loops comprising a set of consecutive lines, wherein each line in the set of consecutive lines comprises a plurality of consecutive loops which are interlooped with adjacent loops of the respective line and are not interlooped with loops of a line which is not contained in the set, wherein the set of consecutive lines forms at least a portion of an eyelet which is configured to receive a lace, wherein a first line in the set of consecutive lines extends from a first end of the eyelet to a second end of the eyelet and comprises a first number of loops, and a second line not contained in the set comprises all loops between a loop adjacent the first end of the eyelet and a loop adjacent the second end of the eyelet and comprises a second number of loops, and wherein the first number is higher than the second number.

2. The shoe upper according to claim 1, wherein the first line in the set of consecutive lines and a first adjacent line not contained in the set form a first aperture in the knitted component, wherein a last line in the set of consecutive lines and a second adjacent line not contained in the set form a second aperture in the knitted component, and wherein the first aperture and the second aperture are configured for the lace to pass through the first and second apertures.

3. The shoe upper according to claim 2, wherein a number of loops of a line located between the first line and the last line in the set of consecutive lines is higher than the number of loops of the first line and the last line.

4. The shoe upper according to claim 1, wherein the knitted component comprises at least one fusible yarn in the area of the set of consecutive lines.

5. The shoe upper according to claim 1, further comprising an inner knitted layer and an outer knitted layer in a unitary knit construction, wherein the inner knitted layer and the outer knitted layer are connected at least in a collar region of the shoe upper, and wherein the outer knitted layer is put over the inner knitted layer or, wherein the inner knitted layer is inserted into the outer knitted layer.

6. The shoe upper according to claim 5, wherein the set of consecutive lines is located on the outer knitted layer.

7. The shoe upper according to claim 5, wherein the inner knitted layer and the outer knitted layer overlap in an area of the set of consecutive lines.

8. The shoe upper according to claim 7, wherein the inner knitted layer and the outer knitted layer are not connected in the area of the set of consecutive lines.

9. The shoe upper according to claim 5, wherein the inner knitted layer and the outer knitted layer overlap in an area of an instep of the shoe upper and are not connected in the area of the instep.

10. The shoe upper according to claim 1, wherein the knitted component comprises at least one elastic yarn in an area of the set of consecutive lines.

11. A method of manufacturing a shoe upper, the method comprising:

providing a knitted component;

providing the knitted component with a plurality of integrally knitted lines of loops comprising a set of consecutive lines, such that each line in the set of consecutive lines comprises a plurality of consecutive loops which are interlooped with adjacent loops of the respective line and are not interlooped with loops of a line which is not contained in the set;

forming the set of consecutive lines as at least a portion of an eyelet which is configured to receive a lace;

forming a first aperture in the knitted component using a first line in the set of consecutive lines and a first adjacent line not contained in the set;

forming a second aperture in the knitted component using a last line in the set of consecutive lines and a second adjacent line not contained in the set; and configuring the first aperture and the second aperture, such that the lace is configured to pass through the first and second apertures.

12. The method according to claim 11, further comprising: knitting the set of consecutive lines by means of partial knitting.

13. The method according to claim 11, further comprising arranging at least one fusible yarn in an area of the set of consecutive lines.

14. The method according to claim 11, further comprising the steps:

providing an inner knitted layer and an outer knitted layer in a unitary knit construction;

connecting the inner knitted layer and the outer knitted layer at least in a collar region of the shoe upper; and putting the outer knitted layer over the inner knitted layer or inserting the inner knitted layer into the outer knitted layer to form the shoe upper.

15. The method according to claim 14, further comprising forming the set of consecutive lines on the outer knitted layer.

16. The method according to claim 11, further comprising the step of providing at least one elastic yarn in an area of the set of consecutive lines.

17. The method according to claim 11, further comprising placing a pin inside the eyelet formed by the set of consecutive lines and maintaining the pin in the eyelet during heat setting the shoe upper.

18. The method according to claim 11, further comprising heat setting the shoe upper.

19. A shoe upper, comprising:

a knitted component, comprising:

a plurality of integrally knitted lines of loops comprising a set of consecutive lines, wherein each line in the set of consecutive lines comprises a plurality of consecutive loops which are interlooped with adjacent loops of the respective line and are not interlooped with loops of a line which is not contained in the set, wherein the set of consecutive lines forms at least a portion of an eyelet which is configured to receive a lace, wherein a first line in the set of consecutive lines and a first adjacent line not contained in the set form a first aperture in the knitted component, wherein a last line in the set of consecutive lines and a second adjacent line not contained in the set form a second aperture in the knitted component, wherein the first aperture and the second aperture are configured to receive the lace through the first and second apertures, and wherein a number of loops of a line located between the first line and the last line in the set of consecutive lines is higher than the number of loops of the first line and the last line.

20. A shoe upper, comprising:

a knitted component, comprising:

a plurality of integrally knitted lines of loops comprising a set of consecutive lines, wherein each line in the set of consecutive lines comprises a plurality of consecutive loops which are interlooped with adjacent loops of the respective line and are not interlooped with loops of a line which is not contained in the set, and wherein the set of consecutive lines forms at least a portion of an eyelet which is configured to receive a lace, and an inner knitted layer and an outer knitted layer in a unitary knit construction, wherein the inner knitted layer and the outer knitted layer are connected at least in a collar region of the shoe upper, and wherein the outer knitted layer is put over the inner knitted layer or, wherein the inner knitted layer is inserted into the outer knitted layer.

21. A method of manufacturing a shoe upper, the method comprising:

providing a knitted component;

providing the knitted component with a plurality of integrally knitted lines of loops comprising a set of consecutive lines, such that each line in the set of consecutive lines comprises a plurality of consecutive loops which are interlooped with adjacent loops of the respective line and are not interlooped with loops of a line which is not contained in the set;

forming the set of consecutive lines as at least a portion of an eyelet which is configured to receive a lace;

providing an inner knitted layer and an outer knitted layer of the knitted component in a unitary knit construction;

connecting the inner knitted layer and the outer knitted layer at least in a collar region of the shoe upper; and putting the outer knitted layer over the inner knitted layer or inserting the inner knitted layer into the outer knitted layer to form the shoe upper.

22. A method of manufacturing a shoe upper, the method comprising:

providing a knitted component;

providing the knitted component with a plurality of integrally knitted lines of loops comprising a set of consecutive lines, such that each line in the set of consecutive lines comprises a plurality of consecutive loops which are interlooped with adjacent loops of the respective line and are not interlooped with loops of a line which is not contained in the set;

forming the set of consecutive lines as at least a portion of an eyelet which is configured to receive a lace; and placing a pin inside the eyelet formed by the set of consecutive lines of loops and maintaining the pin in the eyelet during heat setting the shoe upper.

* * * * *